US010576323B1

(12) United States Patent
Latella, Jr.

(10) Patent No.: US 10,576,323 B1
(45) Date of Patent: Mar. 3, 2020

(54) NEUROMUSCULAR TRAINING SYSTEM AND METHOD OF TRAINING USING SAME

(71) Applicant: Frank A. Latella, Jr., Wilton, CT (US)

(72) Inventor: Frank A. Latella, Jr., Wilton, CT (US)

( * ) Notice: Subject to any disclaimer, the term of this patent is extended or adjusted under 35 U.S.C. 154(b) by 327 days.

(21) Appl. No.: 15/241,505

(22) Filed: Aug. 19, 2016

Related U.S. Application Data

(60) Provisional application No. 62/206,938, filed on Aug. 19, 2015.

(51) Int. Cl.
*A63B 21/055* (2006.01)
*A63B 21/04* (2006.01)
(Continued)

(52) U.S. Cl.
CPC ..... *A63B 21/0552* (2013.01); *A63B 21/04* (2013.01); *A63B 21/4007* (2015.10);
(Continued)

(58) Field of Classification Search
CPC ... A63B 22/16; A63B 21/04; A63B 23/03516; A63B 23/006; A63B 21/0004; A63B 21/00058; A63B 21/00061; A63B 21/00065; A63B 21/00069; A63B 21/00072; A63B 21/00076; A63B 21/00181; A63B 21/00185; A63B 21/00196; A63B 21/002; A63B 21/0023; A63B 21/02; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/15; A63B 21/159; A63B 21/4007; A63B 21/4023; A63B 21/4025; A63B 21/4027; A63B 21/4033; A63B 21/4034; A63B 21/4035; A63B 21/4043; A63B 22/0002; A63B 22/14; A63B 22/18; A63B 22/20; A63B 22/201; A63B 22/203; A63B 2022/185; A63B 2023/003;
(Continued)

(56) References Cited

U.S. PATENT DOCUMENTS 3,511,500 A * 5/1970 Dunn ..... A63B 21/015 482/113
5,451,194 A * 9/1995 Harrigan ..... A63B 21/0552 482/124
(Continued)

OTHER PUBLICATIONS https://www.youtube.com/watch?v=IDw2p_IYwto, published Apr. 12, 2007, last visited Aug. 5, 2018.*
(Continued)

*Primary Examiner* — Gary D Urbiel Goldner
(74) *Attorney, Agent, or Firm* — DLA Piper LLP US

(57) ABSTRACT

A method of performing a sequential series of movements in order to improve neuromuscular control and function across multiple joints and muscles in an individual. The sequential series of movements are performed by the individual while balancing on at least one unstable surface. Various steps are repeated to create a pattern of sequential movements that create rotational multi-planar movements against resistance and allow selectively sequential stretching of at least one muscle or joint of the individual.

11 Claims, 11 Drawing Sheets

(51) Int. Cl.

| | |
|---|---|
| ***A63B 21/00*** | (2006.01) |
| ***A63B 23/035*** | (2006.01) |
| ***A63B 22/16*** | (2006.01) |
| ***A63B 23/00*** | (2006.01) |

(52) U.S. Cl.
CPC ..... *A63B 21/4025* (2015.10); *A63B 21/4034* (2015.10); *A63B 22/16* (2013.01); *A63B 23/03516* (2013.01); *A63B 2023/006* (2013.01)

(58) Field of Classification Search
CPC ..... A63B 2023/006; A63B 2023/0411; A63B 23/02; A63B 23/0205; A63B 23/0211; A63B 23/0216; A63B 23/0222; A63B 23/0227; A63B 23/035; A63B 23/03533; A63B 23/03541; A63B 23/03575; A63B 23/04; A63B 23/0405; A63B 23/0458; A63B 23/0464; A63B 23/047; A63B 23/0482; A63B 23/0494; A63B 23/08; A63B 23/12; A63B 23/1245; A63B 23/1254; A63B 23/1263; A63B 23/1272; A63B 23/1281; A63B 26/00; A63B 26/003; A63B 41/00; A63B 2041/005; A63B 69/0002; A63B 69/0015; A63B 69/0017; A63B 69/0022; A63B 69/0024; A63B 69/0026; A63B 69/06; A63B 69/18; A63B 69/182; A63B 2069/0004; A63B 2069/0008; A63B 2069/062; A63B 2069/064; A63B 2069/066; A63B 2069/068; A63B 2244/18; A63B 2244/183; A63B 2244/186; A63B 2244/19; A63B 2208/02; A63B 2208/0204; A63B 2208/0209; A63B 2208/0214; A63B 2208/0219; A63B 2208/0228; A63B 2208/0233; A63B 2208/0238; A63B 2208/0242; A63B 2208/0247; A63B 2208/0252; A63B 2208/0257; A63B 2208/0266
See application file for complete search history.

(56) References Cited

U.S. PATENT DOCUMENTS

| | | | | |
|---|---|---|---|---|
| 5,839,968 | A * | 11/1998 | Latella | A63B 69/0057 473/219 |
| 6,176,790 | B1 * | 1/2001 | Latella | A63B 69/0057 273/DIG. 20 |
| 7,513,840 | B2 * | 4/2009 | Latella, Jr. | A63B 15/00 473/219 |
| 8,337,372 | B1 * | 12/2012 | Boterenbrood | A01B 1/02 294/49 |
| 2003/0232701 | A1 * | 12/2003 | Latella, Jr. | A63B 15/00 482/92 |
| 2004/0248703 | A1 * | 12/2004 | Heger | A63B 21/0552 482/79 |
| 2006/0287173 | A1 * | 12/2006 | Guadagno | A63B 21/0004 482/142 |
| 2008/0039291 | A1 * | 2/2008 | Latella, Jr. | A63B 15/00 482/92 |
| 2008/0287274 | A1 * | 11/2008 | Koch | A63B 21/0004 482/148 |
| 2009/0239675 | A1 * | 9/2009 | Wallace | A63B 21/0552 473/220 |
| 2010/0173273 | A1 * | 7/2010 | Bilbao | A63B 21/4015 434/253 |
| 2012/0198594 | A1 * | 8/2012 | Reay | A41D 13/0156 2/2.5 |
| 2017/0232289 | A1 * | 8/2017 | Pouchet | A63B 7/00 482/93 |

OTHER PUBLICATIONS https://www.youtube.com/watch?v=4LIDIXtbFUw, published May 17, 2007, last visited Aug. 5, 2018.*
https://www.youtube.com/watch?v=SuliElxn3s4, published Feb. 2, 2015, last visited Aug. 5, 2018.*
https://www.youtube.com/watch?v=pb65RiBRvZo, published Nov. 13, 2006, last visited Aug. 5, 2018.*

* cited by examiner

NEUROMUSCULAR TRAINING SYSTEM AND METHOD OF TRAINING USING SAME

CROSS REFERENCE TO RELATED APPLICATIONS

This application claims the benefit of U.S. Provisional Application Ser. No. 62/206,938, filed on Aug. 19, 2015, the disclosure of which is herein incorporated by reference in its entirety.

FIELD OF THE INVENTION

The present invention relates generally to a method of performing a sequential series of movements or exercises in a prescribed manner.

BACKGROUND OF THE INVENTION

Many dance and gymnastics coaches rely heavily on static stretching for their athletes, and in some cases require those stretches to be held for 10-30 minutes at a time. In addition, most gymnasts begin training when they're very young as their joints and capsules are incredibly tolerant to stressors and they can get much more mobile young than they can old. If you were able to be very mobile when you were young, there's a much better chance of being mobile when you're older, and especially so if you can pass basic hyper mobility testing.

However, if too much stretch loading is applied to muscles, tendinopathy can result. If too much compressive loading into bones is applied, bone spur formation could result. If on the hips or shoulders, it's called impingement, and may need to be removed surgically to restore range of motion. Each person will have a different threshold, so tread lightly.

Many trainers emphasize lengthening muscle tissues that seem short and tight. However, precise alignment and proper breathing also deliver results that have little to do with stretching and create lasting increases in functional mobility, stability, and mental stamina. This benefits individuals by:

1. activating/inhibiting muscles;
2. using the diaphragm; and
3. initiating their parasympathetic nervous system.

Because many of the positions require multi-planar movement in a controlled manner or positional hold, demanding perfect alignment in those poses forces individuals out of compensation patterns. Taking them out of these patterns activates muscles that have been dysfunctional dormant, and inhibits the overactive compensators (effectively turning off the tension). It's the activation and inhibition initiated, not stretching, that actually helps individuals become more mobile.

When an individual simply stretches chronically tight, overactive muscles, without correcting the cause of the over activity, there may be temporary relief, but increased risk of tearing the muscle and increasing potential for injury. There may also be reduced strength and power, since the individual has likely been using that muscle as a primary source of movement in their sport.

In addition, proper diaphragm use and breathing biomechanics are not only paramount for leveraging the autonomic nervous system but also facilitating integrated core strength, pelvic floor function, shoulder girdle integrity, shoulder mobility, and more.

Consider the most popular, traditional strength and conditioning movements—the ones we love to do (i.e., squats, bench presses, bicep curls, crunches, etc.). What do they all have in common? The sagittal plane. And that's where too many athletes place their training effort, despite the fact that most sports require multi-planar movement (i.e., think of a baseball or golf swing). Consequently, athletes learn to compensate through powerful multi-planar movements in their sport by using the muscles they've strengthened in the weight room.

Understanding this phenomenon, we can better identify the contributing factors to areas of chronic tension and leverage the method to concentrate on specific activation of the muscles that have been inhibited (agonists and synergists) by the tense area's over activity/compensation. In this way, reciprocal inhibition can be used to not only relieve tension, but also to restore kinetic chain firing and functional range of motion. Stretching, alone, can't accomplish that.

In terms of using this information to your advantage in the gym, you can go about it two different ways depending on your goal set. If you're looking for smashing heavier weights in something like a dead lift or a squat, using a fast, plyometric type jump activity immediately prior may be beneficial. If you're looking to sprint or produce maximal velocity contractions, using some relatively heavy loading with a focus on the hardest contractions against the load could be beneficial. This is justification for using the resistance harness and bands in more specific rotational movements.

Studies show that employing the method immediately before performance of a particular movement, golf, baseball swing, archery, discus, etc. improves that specific performance. The main physiological reason for this was to create that excitatory neural response through the muscles, develop a stretch-shortening cycle that would produce a new H-wave of contraction to assist the conscious contraction mechanisms, and essentially help the individual improve "overall" but specific multi muscles against ground reaction forces and resistance of that restive sort or functional movement. pull more weight; much like the countercurrent arm swing would help the vertical jump itself.

This pre-activation can have a massive effect on how one will perform; or rehab, because it stimulates the nervous system to deliver more of a contractile impulse, a faster rate of neural delivery, and an excitatory impulse that can't simply be achieved with conscious contraction alone.

The goal is loaded max velocity contractions, trying to increase how much neural activity is going through the muscles to get a carryover effect to the specific, respective sport movements.

Similarly, the individual could do the method which would improve speed contractions by producing heavy hard contractions prior to speed work. Reaction time, balance, mobility and coordination of movements are enhanced for "any" speed applications.

This increased drive and contraction force leads to faster actions when unloaded during the swing, throwing, sprinting work, and resulted in better times.

Utilizing the method of invention as a neural primer, is a big key to work on activation, and is a carry over to performance benefits.

These neural drive exercises can be a highly valuable addition to any training program that's focusing on performance outcomes like more overall stability, mobility in any sport to the specific nature of multi planar movements. The biomechanical patterns of throwing, sprinting, swinging, agility, stops starts, are all improved though the method of invention.

According to the National Electronic Injury Surveillance System (NEISS), in 2010, lower back strains were the most common reported reason for ER visits relating to yoga. This may be because the sequences of some popular yoga styles feature poses that feed into compensatory back-extension patterns by promoting hyperextension, and counter them with stretches encouraging extreme low-back flexion. Understandably, that combination of movements can be especially dangerous for anyone with a tight lower back.

Individuals with low-back tension usually have excessive anterior pelvic tilts that contribute to in-creased lumbar lordosis. Overactive hip flexors holding the pelvic tilt and inhibit glute firing, which then forces back extensors to compensate as hip extensors.

If we just stretch the low back, which often isn't even possible because the back extensors can't release, we are not fixing the problem because the low back will immediately reengage in response to the hip flexors pulling on the pelvis. And, as the ER-visit data shows, we could strain the low back in the process.

Instead, it may be more beneficial to start with movements that promote glute activation and hip flexor inhibition, like bridging, while maintaining pressure in the lateral heels and medial arches to facilitate glute and adductor engagement. Avoid lifting into back extension. Inhale as you lift your pelvis. Exhale to bring your pelvis down. If the knees bow out or you have trouble maintaining medial arch awareness, hold a foam yoga block or ball between your legs to ensure adductor engagement.

All muscles contract due to signals sent from the nervous system. There are ways to take advantage of built in reflex loops that can cause muscle contraction without conscious thought, much like how you would pull your hand back from a hot stove before even realizing it's hot, and how individuals with spinal cord injuries and who are essentially paralyzed can still have muscle spasms in their legs as a protective measure.

Certain researchers have looked at electric stimulation of motor units in stroke patients, comparing their affected side to their non-affected side and to healthy controls and have found the stimulation to the affected side still produced a motor unit activation, but in a slightly delayed manner on compared to both the healthy controls and the non-affected side, and wasn't reproduced with simple skin brushing.

In terms of how a motor unit creates an action potential, or a muscle contraction, the sequenced actions of contraction can be summed up as depicted in FIG. 1.

The initial part is the muscle seeing a change in polarity due to the incoming neural impulse, and depends mostly on the position of the probe in relation to where the motor endplate is located. The first spike is when the end plate of the motor unit sees the first depolarization, or in other words the first muscle contraction. There are usually multiple spikes, which help to extend the duration of the contraction without being a constant signal.

The terminal part is a repolarization of the muscle, preparing for the next contraction. Depending on the individual, this phase could be very quick (solid recovery and high work capacity) or very long (detrained and not good at recovering from exertion).

The present invention provides an improved successful method for increasing core stability and flexibility. However, while creating stability locally through the core, the present invention also improves muscle activation/inhibition sequencing which improves flexibility, strength, and motor learning, throughout the entire body.

The sliding filament theory describes how a muscle contracts. At a very basic level each muscle fiber is made up of smaller fibers called myofibrils. These contain even smaller structures called actin and myosin filaments. These filaments slide in and out between each other to form a muscle contractions, hence called the sliding filament theory.

Here is what happens in greater detail:

A) An impulse arrives at the neuromuscular junction, which causes a release of a chemical called Acetylcholine. This causes the depolarization of the motor end plate which travels through the muscle via the transverse tubules, causing Calcium to be released from the sarcoplasmic reticulum.

B) The Calcium binds to Troponin (an actin-binding protein which regulates muscle contraction), changing its shape and so moving Tropomyosin (complex of three proteins, attached to Tropomyosin) from the active site of the Actin. The Myosin filaments can now attach to the Actin, forming a cross-bridge.

The breakdown of ATP releases energy which enables the Myosin to pull the Actin filaments inwards and so shortening the muscle. This occurs along the entire length of every myofibril in the muscle cell.

The Myosin detaches from the Actin when an ATP molecule binds to the Myosin head. When the ATP is then broken down the Myosin head can again attach to an Actin binding site further along the Actin filament and repeat the "power stroke." This repeated pulling of the Actin over the myosin is often known as the ratchet mechanism.

This process of muscular contraction can last for as long as there is adequate ATP and calcium stores. Once the impulse stops the Calcium is pumped back to the Sarcoplasmic Reticulum and the Actin returns to its resting position causing the muscle to lengthen and relax.

The key to creating movement intelligence is to be consciously aware of movements, and of the information the body is absorbing. To do this, stimuli are created to elicit a movement reaction through a variety of tasks or exercises. As skill improves, more stimuli are needed to continue improvement. This type of exercise planning involves integration of the mind and body, combining balance, strength and quickness. The result is a heightened ability to make spur-of-the-moment decisions about what is needed capabilities are in any given situation.

Most sports require rotational movements, under the influence of gravity in a three-dimensional environment. If the exercises in any program do not contribute to, or directly enhance the athlete's ability to maintain his or her center of gravity over their base of support the functional carry-over is likely to be minimal.

Most sports also require the performance of highly technical movements while maintaining the athlete's center of gravity over his or her base of support. The inability to maintain a center of gravity during the movements will reduce the chances of maintaining an optimal rotational axis, and limit the rhythm senses of muscle intensity and angular movements, thereby reducing the chances of performing with any consistency.

Additional claims by the method of invention are based on the inherent benefits to reducing physical limitations that present in specific movement positions, sport specific positions and performance technique. Increased rehabilitation protocols, exercise training, sports conditioning programs, and subsequent sport performance, all place increased mechanical changes on the body. Given certain disabilities, i.e. an amputee, these mechanical demands are exacerbated.

The most significant improvements for overall performance of any movement is through "neuro-muscular training."

A perfect example is in the rapid rotation of the upper arm at the shoulder joint of an overhead athlete; throwing a baseball, performing a tennis overhand stroke, swinging a bat, or golf club, throwing a shot or javelin. It is the result of the internal rotator muscles (i.e. latissimus dorsi, pectoralis major, subscapularis, teres major, and anterior deltoid, pulling on their respective attachment to the upper arm. In order to provide for optimal shoulder joint function and generate the high speed rotation of the upper arm, the shoulder muscles need to coordinate forces to the upper arm and shoulder blade. These forces and torque load the "body" which, as a result, may lead to injury if not controlled correctly.

Since multiple muscles are involved in the muscle-tendon structure at each joint, and multiple joints (multiple muscles) are involved with rotation in sports performance, the method of invention addresses the key issue of how the total force and torque load are distributed among the muscles. The method of invention considers the distribution dependent forces on the motion of the foot, AND the position AND the motion of the entire body, with respect to mobility, activation/inhibition, balance, strength and spatial awareness.

The method of invention stresses proper biomechanics which not only paramount for leveraging the autonomic nervous system, but also facilitating integrated core strength, pelvic floor function, ankle, knee, hips shoulder, wrists, neck girdle integrity, mobility, and more.

Because many of the positions require multi-planar movement in a controlled manner or positional hold, demanding perfect alignment in those positions forces students out of compensation patterns. Taking them out of these patterns activates muscles that have been dysfunctionally dormant, and inhibits the overactive compensators (effectively turning off the tension). It is the activation and inhibition initiated, not stretching, that actually helps students become more mobile.

When you simply stretch chronically tight, overactive muscles—without correcting the cause of the over activity—you can provide temporary relief, but you risk tearing the muscle and increasing potential for injury. You might also reduce strength and power, since the individual has likely been using that muscle as a primary source of movement in their sport.

Take, as well, the sport of golf. Swinging the club is a whole body skill, requiring the understanding of the neuromuscular components of each body segment and its respective role in the performance of the swing. Considerable effort is required, at first, to train the specific action of the specific positions, balance and posture as the body becomes better educated as to how to work these muscle groups more efficiently. Each muscle group has a specific skill to perform. Once the basic skill set is learned, it can only then be integrated into the whole and more improved golf swing. Then with proper, more sport specific practice, the refinement of technique becomes more "practically" integrated into the more efficient golf swing. It will become more automatic with fewer unwarranted and invasive swing thoughts. The proper mental understanding of how the joints and muscles of the body work together to perform the golf swing is more easily attained.

The method described herein is based on the neurophysiology of how the brain controls the muscles, joints, and all soft tissue of the body. It is the brain that sends the message to move so the importance to this motor learning to produce a more efficient golf swing cannot be understated. Simply put, specific muscles move specific joint a specific way. The kinematic sequence is being trained more efficiently. Faulty swings are a direct result of some incompletion, interruption, or omission of the movement message from the brain to the anatomy involved in the completion of the swing.

A basic understanding of joint structure is important. Simply stated, a joint is formed when two bones come together. Skeletal muscles attached to the joint by tendon and held together by ligaments attaching bone-to-bone produce the movements of any joint. Because muscles originate on one bone and cross the joint to attach to another bone, the movements are meant to be directed in a certain way. You have primary movers, or agonists, and stabilizers called antagonists. They need to work together, synergistically, to produce any refined movements.

The actions of the golf swing are unique in that at no other time do we need to perform these actions in their specific kinematic sequence. In other word, your swing is like a fingerprint; it is unique to you. It cannot be trained unless it mimics the unique and specific neuro-physiological characteristics of your body.

Both static and dynamic forces can lead to improper biomechanics. Static forces involve the effects of gravity on muscles, joints, and bones. Golfers naturally stand in a sway back posture, with their pelvic girdle forward of the line of gravity. Most often, the golfer will have a lengthened external oblique and shortened rectus abdominus. This leads to decreased demand on the hip extensor muscles and results in significant atrophy of the glutei muscles, setting the golfer up for stress to the hip and spine.

Improper static alignment or posture at address position continues to cause biomechanical problems when dynamic forces are initiated (swing the golf club); by creating moments that will cause joint misalignment. These moments—as well as the frequent patterns of movement—can become factors in the movement system imbalances, as they lead to changes in the recruitment pattern of muscles. This in turn will alter swing performance and cause a change in the pattern of joint movement in each swing phase. These altered changes can create micro trauma to soft tissue arising form compensatory movements.

The method described herein can help reduce these compensatory movements by practicing frequent, deliberate and efficient movement patterns in an optimal and dynamically balanced posture.

Increases in muscle extensibility observed immediately after stretching and after short-term (3 to 8-week) stretching programs are due to an alteration of sensation only and not to an increase in muscle length. This theory is referred to as the sensory theory throughout this article because the change in subjects' perception of sensation is the only current explanation for these results. The method of invention improves this phenomenon of alteration to sensation.

Note the very interesting and sensible phrasing, "the only current explanation." That's a very Sherlock Holmesian way of putting it: "Once you eliminate the impossible, whatever remains, no matter how improbable, must be the truth." It's a strange, cool, and unexpected conclusion . . . but it's also all we've got left, so we should probably take it seriously.

Increased flexibility may simply be an increased tolerance for the discomfort of excessive muscle elongation. The neuro-physiology of the method, the proprioceptive enhancements of pliable discs, and pliable bands, Muscle (probably) doesn't change, especially in response to an average stretching regimen, but our willingness to elongate it probably does. Going with this theory, elongation must normally be limited by a strict neurological edict. The brain and spinal cord decree: you're only going to lengthen your muscles so far, period, end of discussion. It's not a negotiation . . . at least not in the short term. Don't make the mistake of thinking you could just blast through that barrier with will power.

There is a strong analogy here to strength: we always have much greater muscle power available than we can safely use. We have deep reserves that are literally impossible to tap into on short notice, without large squirts of adrenalin. Contractions are normally reined in by the brain. Even with a powerful grunt of effort, only a small fraction of your muscle fibers get a signal to contract at any one time. If you recruited all of them, you might rip the muscle off your bones, or at least completely exhaust yourself in seconds. Your central nervous system has excellent reasons for imposing a power limit. Full contraction is for dramatic, obvious, life and death situations only.

However, with training, we can learn to recruit more fibers. In fact, when people train their muscles, early strength gains may be mainly a matter of learning to "recruit" more muscle fibers at once. However, recruiting them in correct bio-mechanically/functionally proper positions is the key.

Here's an interesting example from science of how increasing flexibility may be more of a nervous system "hack" than a matter of changing tissue. It appears that if you just add some vibration, even already flexible gymnasts can get a surprising boost in flexibility. Researchers have demonstrated that vibration could enhance flexibility."

Discs and pliable harnesses, smart stick and tubing equipment offers this same "vibrating" phenomenon when used in the manner described herein.

Rochester et al., "The influence of eccentric contractions and stretch on alpha motor neuron excitability in normal subjects and subjects with spasticity," Electromyogr. Clin. Neurophysiol., Vol. 41, No. 3, pp. 171-177 (04/2001), describes that the application of eccentric contractions and muscle stretch are clinically effective in reducing spasticity and increasing ROM, which may be explained by a change in the excitability of motor neurons supplying the spastic muscle. Excitability of motor neurons can be indirectly assessed using the H-reflex.

Gabriel et al., "Neural adaptations to resistive exercise: mechanisms and recommendations for training practices," Sports Med. Vol. 36, No. 2, pp. 133-149 (2006) describes that neural factors play an important role in muscle strength gains. This article reviews the neural adaptations in strength, with the goal of laying the foundations for practical applications in sports medicine and rehabilitation.

Eccentric contractions are the opposite of concentric contractions. The muscle contracts but increases in length. This type of contraction occurs usually in the direction of gravity, to control a movement. For example, using the biceps curl exercise—as the arm is slowly straightened from the bent position, the Biceps Brachii muscle contracts eccentrically to control the downward movement and increase the angle at the joint.

Eccentric contractions are much more challenging on the muscle and so should be used in the late stages of rehabilitation only. However, they are very important in the rehabilitation of many injuries, especially for hamstring strains and Achilles tendinopathy.

The method of invention, with the rotational multiple movements, mobility, stability against resistance increase this neuro-physiological phenomenon.

SUMMARY OF THE INVENTION

It is an object of the present invention to improve physical limitations that preclude individuals with disabilities, from leading a better quality of life.

It is another object of the present invention to perform a sequential series of movements in order to improve neuromuscular control and function across multiple joints and muscles.

DETAILED DESCRIPTION OF THE PREFERRED EMBODIMENTS

In one embodiment, the present invention relates generally to a method of performing a sequential series of movements in order to improve neuromuscular control and function across multiple joints and muscles, wherein the series of movements are performed by an individual, the method comprising the steps of:

a) balancing on at least one unstable surface; and b) performing a series of selective sequential exercises capable of evoking specific motor responses in at least one muscle or joint for which it is desired to create functional resistance, said series of selective sequential exercises comprising:

i) stretching the at least one muscle or joint by applying tension to the at least one muscle or joint, wherein the tension is applied by a stretching motion;

ii) keeping the tension applied to the at least one muscle or joint for a period of time;

iii) pivoting/twisting/engaging the torso or trunk and holding the pivoting/twisting/engaging position for a period of time;

iv) optionally, repeating steps i) through iii) multiple times to create a pattern of sequential movement;

wherein the pattern of sequential movement creates rotational multi-planar movements against resistance, and wherein the pattern of sequential movement allows selectively sequential stretching of the at least one muscle or joint.

For example, by standing on balance discs, the vestibular reflex responses are immediately innervated by the brain's "fight or flight" mechanism. The entire muscular-skeletal system is engaged to keep the individual upright.

The pressure sensing receptors in the feet, translate deformation information at each subsequent joint form the ankles to knees, to hips, to trunk, to shoulders to neck, to brain and back.

Figure 4:
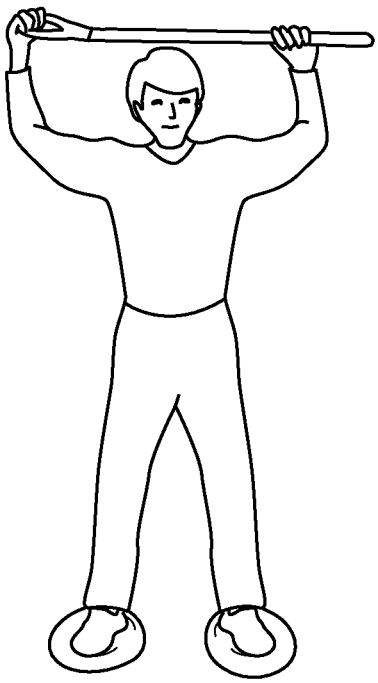
FIG. 4 depicts a view of a step in a sequence of movements in accordance with the present invention in a standing position.

As an example, in combination with holding the stick and elastic toner overhead as shown in FIG. 4, the vestibular response is elevated even further, through increased vibrations, and oscillations, throughout the entire muscular-skeletal structure.

Additionally, the pressure sensing receptors in the hands holding the stick and elastic toner are stimulated to generate action potentials at the neurons of the afferent system with resultant pressure information being carried to the appropriate center in the central nervous system.

Figure 5:
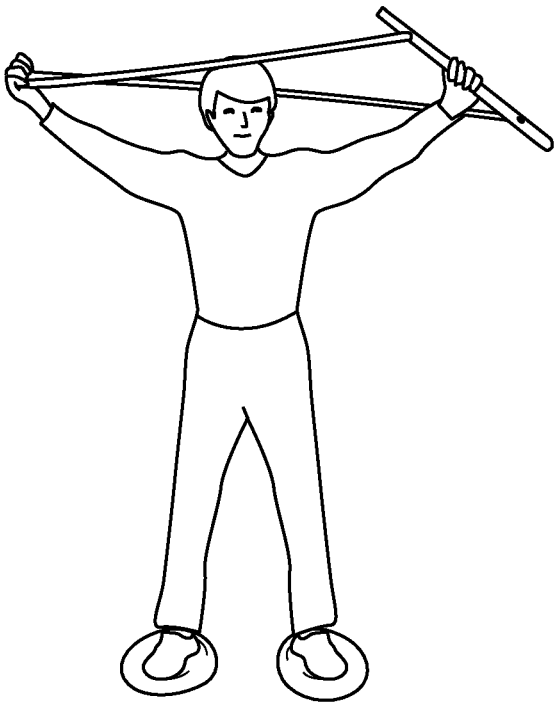
FIG. 5 depicts another view of the step in the sequence of movements shown in FIG. 4 in accordance with the present invention.

Upon initiation of the separation of arms as shown in FIG. 5, pulling in opposite directions, muscle contractions are exacted through its efforts according to the level of grip pressure, along with increased vibrations/oscillations provided through stretching the elastic toner.

The method described herein facilitates activation of the transversus abdominis, diaphragm, multifidus and pelvic-girdle muscles. This activation, along with the challenge provided by limb perturbation (with patented elastic resistance apparatus, balance discs), and the specific sequence of movements, contributes to neuromuscular improvements in trunk control and lumbo-pelvic stability. This sequence upon which proper activation/inhibition is founded, will enhance the neurophysiologic properties of contractile tissue, improving properties of activation/inhibition, which enhances mobility, stability, flexibility and strength—while performing multiple muscle, specific rotational and sport specific movements for any functional joint In addition to core muscle activation, the present method integrates whole-body, flowing movements into the end range of joint motion without causing discomfort. By incorporating both rotation against resistance with dynamic movements; through specific, sequential functional movement patterns, the present method enhances the neurophysiologic properties of contractile tissue, improving properties of activation/inhibition, mobility, stability, flexibility and strength—while performing any movements.

The present method also affects motor learning by requiring individuals to focus and heighten their proprioception, or body awareness; physical cues, internal feedback, which helps improve the brain body connection. Through sequenced repetition and practice, individuals adopt new or improved movements that eventually become automatic. These more coordinated motor pathways help reduce the physical limitations in specific rotational, simultaneous multi muscle movement and sport specific movement patterns.

Thus, as can be seen by the description provided herein, in a broad sense, the present invention is directed to a neuromuscular training system that is concerned primarily with the activation of stabilizers. The body is basically unstable. Although muscle groups such as the adductors, rotator cuff, hip rotators, deep abdominals and deep cervical flexors are known for their roles as postural and stabilizer muscles, nearly all the muscles throughout the body act as stabilizers at one time or another. Of critical importance, with regard to maintaining one's center of gravity over one's base of support, is performing exercises that require the body to stabilize not only what appear to be the working joints, but all joints associated with any given movement.

The present invention is a deliberate strategy for neuromuscular activation, including activation of muscular stabilizers. This is to be contrasted with the incidental (and haphazard) activation of divergent connections within the central nervous system which occurs in ordinary exercises, and which cannot help but result in inconsistent movement and the development of movement flaws. Moreover, because the absence of proper stabilizer activation results in movement flaws, the athlete soon develops atypical movement patterns (compensations) which are directed not at apparent motor tasks but at less obvious performance characteristics related to postural stabilization, avoiding uncomfortable or painful body movements, and reducing the risk of injury.

In sports, as in life, no one muscle works alone. Even large muscles, such as the pectorals, the chest muscle, works in concert with nearly every other muscle in the body. Therefore, isolated strengthening in an environment distinctly different from the sport will not be very beneficial. The bench press exercise as performed in an exercise machine minimizes the requirement for stabilization of the arm by the rotator cuff because the machine stabilizes the load, requiring only force generation in one plane of motion. While the muscle may grow larger, and a greater degree of strength may be clinically measurable, that additional strength will be only tangentially useful for any physical activity. Sport movements are dynamic, taking place in a real-world, three-dimensional, context.

Motor unit synchronization is a measure of the correlated discharge of action potentials by motor units and is quantified by both time- and frequency-domain analyses from pairs of motor units. The measurement of motor unit synchronization reveals details about the distribution and plasticity of shared, branched-axon inputs to motor neurons arising from the cortical spinal pathway. The acute and chronic plasticity of motor unit synchronization suggests that it must represent a deliberate strategy for neuromuscular activation. Although increased motor unit synchronization contributes to larger force fluctuations, when the musculotendinous unit or joint capsules shorten, the body's mechanics are altered, progressively disrupting sport mechanics.

Since muscles attach to both sides of a joint and act synergistically, the neuromuscular principles of the present invention improve biomechanics through increased stability, flexibility, strength and power, by creating greater synergy (balance) between agonist/antagonist groups.

Depending on the respective joint motions involved (i.e., internal/external rotation, flexion/extension, etc.) synergy is altered in these groups if limitations in flexibility present in the specific sport positions. Therefore the mechanics of the sport movement are altered. This means compensation; the more an athlete compensates for the altered joint mechanics, the more technique faults incurred and the less consistent the athlete will be.

When one evaluates the movement of the joints involved in any sport there are certain "physical flaws" presented which dictate technique. For example: a common problem experienced in the sport of archery is restricted shoulder range of motion. Compensation may be excessive spinal rotation or elevated draw elbow position.

Based on these examples and other technique faults, the method described herein has proven invaluable in reducing the physical limitations that present in archery specific positions.

The best athletes in the world have developed techniques that produce greater force, control and consistency. One of the primary reasons is that they have developed their own unique pattern of movement that produces increased body balance, heightened awareness, strength and power, which in turn, creates high speed at the most distal end of the kinetic chain—in any sport. This is based on a sequence of body segments that maximize the force producing capacity of our muscles.

Most any sport performance is a complex sequential action involving both stabilization and movement forces on the hips, trunk, shoulders, and movement of the arms, wrists, and hand. The success of this action is the timing of the involvement of these body segments, which can only produce consistency and maximum speed, if balance, flexibility, strength and power are optimized. If not optimized, any one of these components interrupts the "summation of forces" principle that is essential for efficient technique.

Altered physical properties, flexibility, stability, and strength, are paramount to any discussion of technique. The present invention involves neurologically-based movement patterns, relating to the sequencing and timing associated with sports movements, and stresses the importance of flexibility under balance, as a biomechanical consideration, which will influence muscle and tendon elastic energy and subsequent force production. The strength and power associated with this phenomenon cannot be overstated.

When looking to create a neural response to training, the method of invention works on some of the spinal reflex loops that produce these involuntary contractions, which usually occur with a higher amplitude and faster rate of contraction that conscious thought normally produces. One such example is the Hoffmann reflex. This is the classic test a doctor would use to determine if there is any spinal reflex defect by flicking your middle or ring finger and seeing a contraction of the thumb flexor muscle in response to the stimuli.

Figure 1:
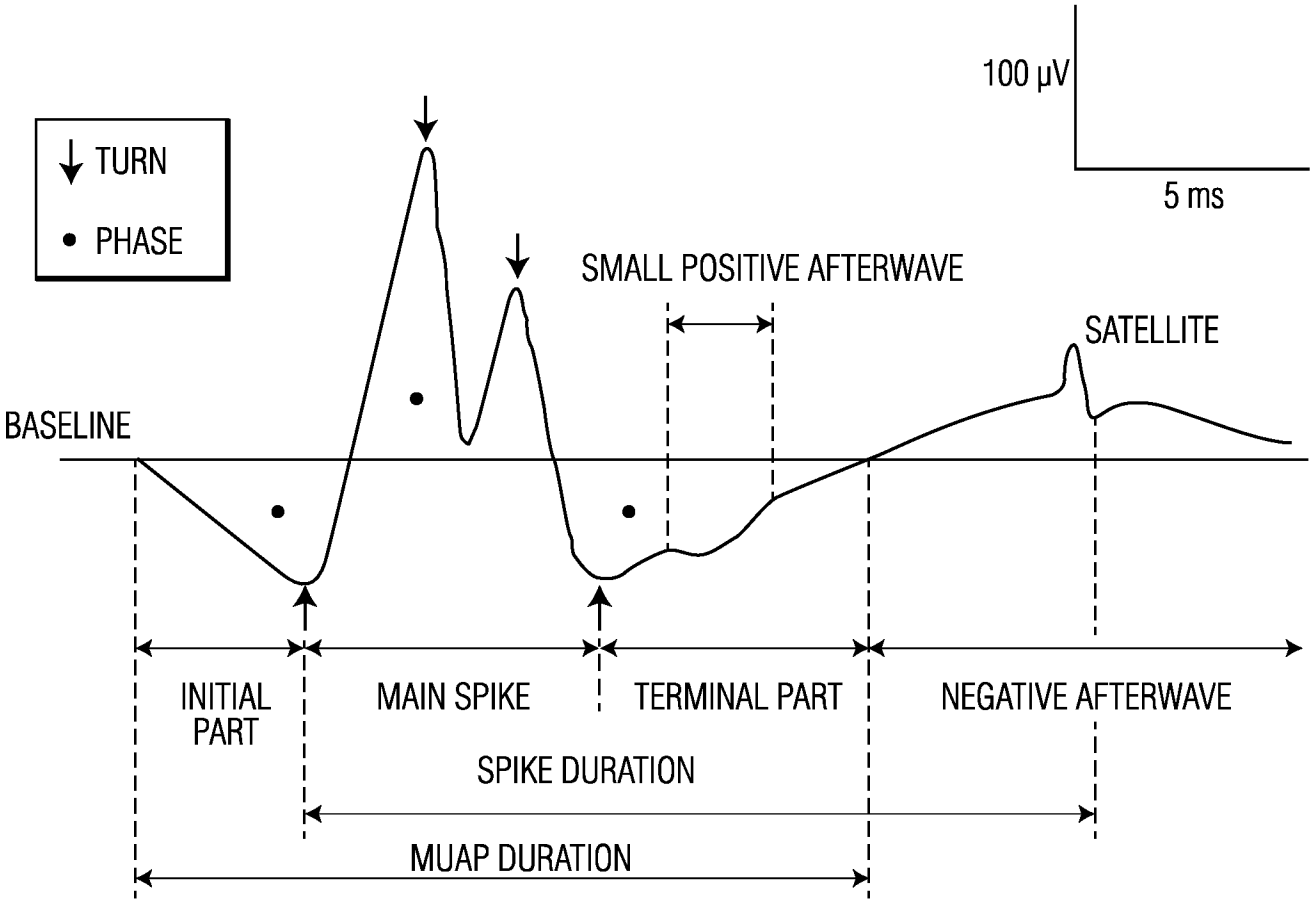
FIG. 1 depicts the sequenced actions of muscle contraction.
Figure 2:
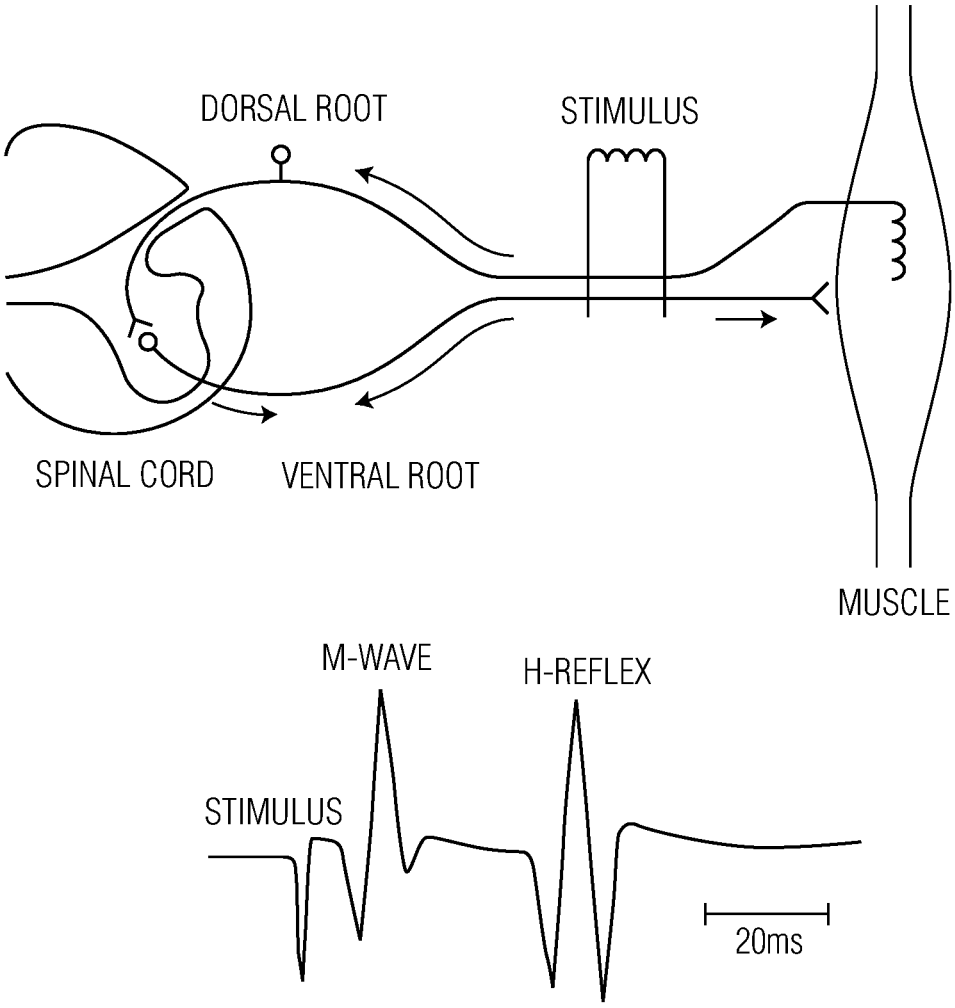
FIG. 2 depicts a view of the H-wave of muscle contraction.

When looking at neural conduction during something like a jump or a run stride, you can see this as a secondary contraction following impact that isn't necessarily driven through conscious thought, known as the H-wave as shown in FIG. 2.

One reason why people trying to do a max height jump do some form of pre-stimulation, like a step up, primary jump, or countercurrent arm movement is to load up the stretch response and take advantage of the H-wave contraction shown in FIG. 2, which can add in to the conscious force production and result in a higher jump.

The inventors of the present invention have found that the method described herein, including the features of rotation against resistance, and neuro stimulation of the vibrations in adapted equipment, provides the same neuro muscular benefits.

Realizing that the "brain" and central nervous system comprise the body's computer system, the method described herein is designed under the premise that the peripheral nervous system—the muscular system—would have absolutely no chance of performing any coordinated movements if specific information is not carried to and from the brain and central nervous system. With this in mind, the sequencing of the present is of significant importance as it relates to "each" of the drills which contain functional-rotational, multiple muscle activation/inhibition drills, including stability, mobility, strength; increasing the coordination of any movement.

With this in mind, the performance of each drill is designed to enhance all sensory motor and "coordination" centers of the brain:

The sensory motor cortex receives information from any or all other senses of the body. All this information is then fed to the motor cortex which in turn sends an electrical signal to the muscles of the body to direct a particular action.

The spinal cord is the balance center, which provides a completely automatic response, unless otherwise training for balance; which requires thinking as part of the learning process. Balance reflex is triggered entirely within the spinal cord. There just is not enough time allowed for the brain to think about what to do, and then send a signal to the muscles to provide balance. However, balance is improved through each drill sequence within the method of invention; thereby enhancing the automatic brain body reflex within the spinal cord. This improvement in balance reflex is heightened with drills designed to test balance while performing functional multiple muscle movements of rotation against resistance, in biomechanically correct and/or performance specific positions.

The brainstem has its primary physical function as being proprioception (the sense of one's position of body parts in space), and each drill sequence in the method of invention is designed to test and improve position sense. Because the design of each drill is centered on establishing balance, created through use of unstable platforms for each drill, along with the use of elastic devices, the automatic balance reflex is enhanced. The brain's monitoring system, experiences the effects of functional rotational movements against resistance, through the perturbations and increased oscillations experienced by the user, which, in turn, promote a higher percentage of muscle tissue innervations, increasing muscle coordination throughout each specific drill. This increase in ability of the brain to better monitor position sense is greatly magnified through the elastic components within the method of invention, as opposed to using any sort of solid implement to perform the drills.

The cerebellum assists with coordination precision and accurate timing. The design of each drill sequence within the method of invention, training on destabilized surfaces, performing multiple muscle movements with functional rotation against resistance; utilizing elastic implements, magnifies the coordination process of the cerebellum through increased perturbations and oscillations when performing each drill.

The temporal lobes are associated with long term memory. When performing the drills within the method of invention, the enhanced sensory experience, (motor learning), of each drill allows for heightened retention of successful, more precise coordinated movements, which are easier and more consistently duplicated when performed in the future.

The cerebral cortex is associated with problem solving and initiating conscious movements and is heavily involved with learning new activities or skills. However, once the skill is learned, it is imperative that the thinking part of the brain be turned off in order to allow the individual to perform a more automatic response to movement. Critical to the design of each drill in the method of invention, is the ability to enhance this motor learning process by performing multiple muscle movements with functional rotation against resistance, in combination with utilizing elastic implements. All of which, successfully promote an improved brain-body, sensory motor connection.

The parietal lobe has a primary function that is associated with movement, recognition, perception, and orientation, along with organizing the system to represent the surroundings. Critical to the design of each drill in the method of invention is the ability to enhance this motor learning process through training on destabilized surfaces, performing functional multiple muscle movements with rotation against resistance utilizing elastic implements. All of which, in combination, successfully promote an improved brain-body connection.

The nervous system is the command and communications network of the body. It consists of the brain which is the control center and the location where voluntary movements are initiated. The spinal cord serves to send commands to and receive inputs from different parts of the body. The peripheral nervous system, musculature, is divided into the afferent system and an efferent system.

The nervous system communicates with other parts of the body by means of action potentials, which are generated when sensory receptors are stimulated, as with the method of invention. In response, an impulse from the efferent system's nerve cells stimulates skeletal muscle fibers to contract. Once stimulated, an impulse from the specific nerves cells stimulates skeletal muscle fibers to contract. Thus, when an athlete initiates movement, receptors located in the feet, up through all the muscles in the lower body to the trunk, arms, shoulders, head and neck, are stimulated to generate action potentials. The pressure of the ground against the feet and all other information is carried to the appropriate center in the central nervous system where muscle contractions are innervated, according to their specific and respective sport functions. In short, all muscle activity in sports is regulated in response to the information provided.

Figure 3:
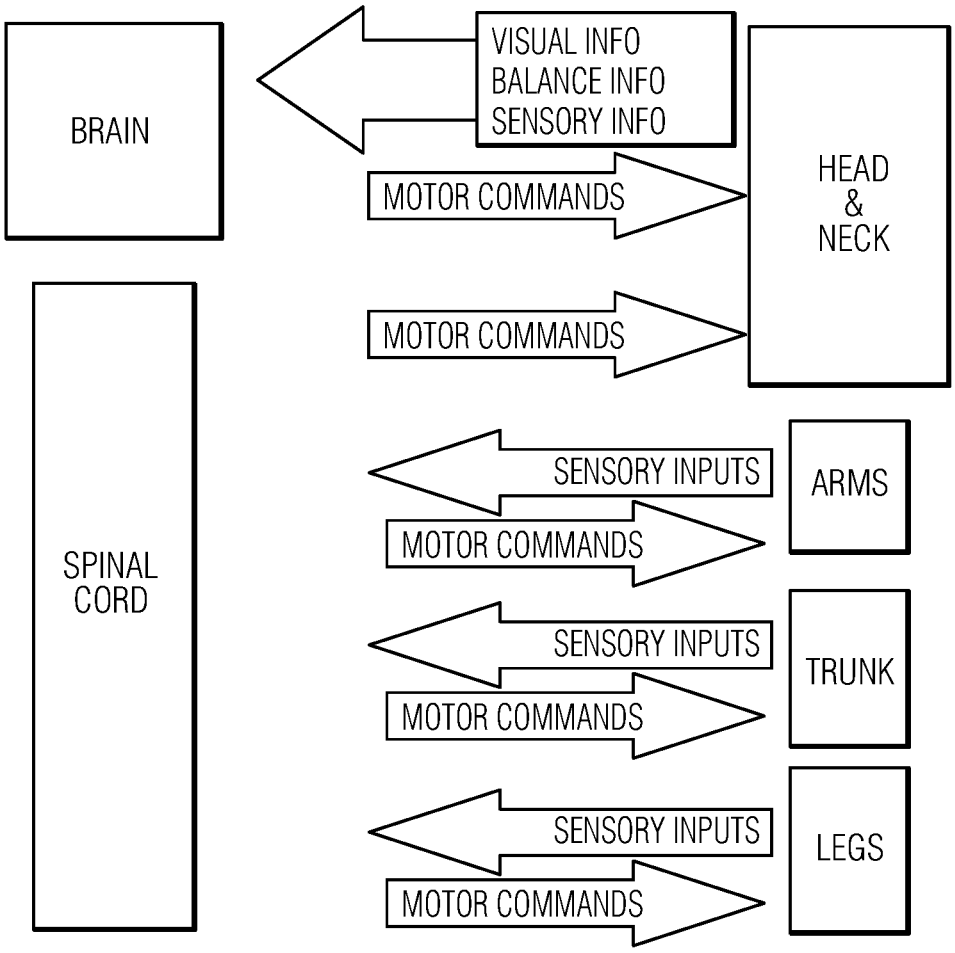
FIG. 3 depicts a diagram of a general representation of the movement control system in humans.

FIG. 3 is a diagram of a general representation of the movement control system in humans and is a specific conscious design representation behind the method of invention.

It is important to understand that motor nerve fibers that have their neurons in the central nervous system innervate skeletal muscle fibers. The number of muscle fibers innervated by a single nerve fiber varies greatly. One motor nerve fiber plus all the muscle fibers it innervates is called a motor unit. The amount a muscle contracts depends on the number of active motor units in the muscle. The smoothness of a movement, especially one that requires a skilled technique, results from the sequential response of many motor units as they work to reinforce and diminish the amount of contraction in the performing muscles.

The inherent benefit of the method of invention is through optimizing vestibular senses to increase the proprioceptive response; coupled simultaneously with increasing vibrations/oscillations, through sequenced drills of rotation against resistance with elastic tubing and or elastic harness. This produces a significantly higher percentage of motor unit recruitment as they reinforce and diminish the amount of contraction in the operating muscles.

Proprioception is the ability of an individual to recognize the location and rate of moment of one body part in relation to its other parts. Proprioception, defined as body position sense—the ability to know where our body is at all times, refers to our uncanny ability to know almost exactly where our arm, leg or finger is, without looking at it. With proprioception, you can estimate the angle of your elbow, the position of your hand and the spread of your fingers. If you had to touch your nose, you could do so, even with your eyes closed.

The proprioceptive system relies on input from the vestibular apparatus of the inner ear, plus information it receives from specialized sensory receptors in the skeletal muscles, tendons and joints. Most of the sensory receptors found in joint capsules and ligaments emit a small percentage of action potentials per second as a resting output. Upon movement, these joint receptors are stimulated due to their deformation, a change in shape to the application of some stress. Therefore, joint receptors provide a continuous stream of information to the central nervous system regarding the position and rate of joint movement.

The ultimate purpose of proprioception is to control the way we move. It gathers continuous input from the millions of sensors in the skin, muscles, joints and ligaments, combines it with the input from our five main senses, and uses it to control our balance, co-ordination, posture and movement. The present invention has the unique principle to facilitate, enhance this proprioceptive phenomenon which may help reduce physical limitations that present in any movement pattern.

Whether we're picking up a glass, swinging a bat, reading a book, or walking down a step, proprioception is constantly monitoring the input from the nerve sensors in your body, to make sure that the output to your muscles is as perfect as possible. It is a complex system, diverse and adaptable that no amount of robotic or computing power can come close to duplicating the smooth and coordinated movements of the human body. The present invention enhances the necessary motor learning to facilitate such movements, particularly with individuals with disabilities.

Proprioception is an automatic sensitivity mechanism that sends messages through the central nervous system ("CNS"). The central nervous system transmits information throughout the body about how to react and with what amount of tension. Human beings "train" for proprioception in the quest for efficient everyday movements. Proprioception is unconscious initially, but can be enhanced with training. Specialized sensory receptors in the muscles, joints and connective tissues enable the body to process information from a variety of stimuli, and turn that information into action.

Through conscious appreciation and cognitive processing of the body's position in space, the central nervous system and the specialized sensory receptors can be conditioned to be more responsive to the length and tension in the muscles and tendons. Additionally, the skin, palms of the hands, soles of the feet and other body parts collaborate to communicate with the brain about muscle tension, weight shifts, load and range of motion.

There is a fine, though dynamic, line between proprioception and kinesthetic awareness. Improving one often improves the other. For example, performing any functional exercise that requires you to maintain your center of gravity over your base of support will contribute to improvement of kinesthetic awareness (a sense of one's whole body), as well as proprioception. An example is snowboarding, which requires reflexive movement intelligence. When surfing down a mountain at high speed, all at once you must be able to sense the position of your limbs relative to the rest of your body, the position of your body relative to the earth and gravity, and the interaction with the board and mountain terrain. Your body automatically coordinates with the stimuli obtained from the immediate experience and turns them into physical action.

Somatosensory input provides information concerning the orientation of the body parts to one another, and postural control. Proprioception is a specialized sensory modality of touch that encompasses the sensation of joint movement (kinesthesia), and joint position sense. Working together, somatosensation and postural balance utilize sensory input related to movement and posture form peripheral sensory receptors; muscle, joint, and cutaneous receptors. These organs detect the sensations of touch, pressure, vibration, and tickle—tactile senses. Proprioceptors, the senses of position, velocity, and tension, are what determine the relative golf positions and movement rates throughout all swing phases. These receptors are found abundantly throughout joint, muscle, connective and ligamentous tissues.

Within skeletal muscle are muscle spindles, having their own special nerves to relay information about the rate and degree of stretch in the muscle, to the spinal cord and back. The Golgi tendon organ is a stretch receptor, usually located in the tendon near its connection to the muscle. Its primary function is to sense muscle tension. Another inherent benefit of the method of invention is that through optimizing balance, vibrations/oscillation of sensory receptors through pressure sensation in the feet, hand, trunk (when seated on unstable surface), it creates a higher percentage of motor unit recruitment resulting in better balance, increased aware of body part positions, that reinforce and diminish the amount of contraction in the operating muscle(s) group(s). Good proprioceptive awareness is of fundamental importance with anyone, more so when an individual's balance is already challenged.

The methods described herein can help "diagnose," and then be utilized for any other limitation. It is a multi-muscle, functional approach to problem solving tied to, and actually assisting in, the diagnosis of other limitations which may inhibit the specific functional movement of any one joint. In other words, the whole brain body (neurophysiologic) approach to any one area of distress.

The method employs movements that promote glute activation and hip flexor inhibition, promoting stability while encouraging proper mobility, through sitting, standing or kneeling on pliable surfaces, with one or more feet or knee, singularly or together placed on unstable discs. Maintaining pressure in the lateral heels and medial arches to facilitate glute and adductor engagement, avoid lifting into back extension are rudimentary to all drills contained in the method of invention. Without which, more ideal neuromuscular activation-inhibition and proprioception cannot be sequenced Creating rotational, multi-planar movements against "pliable" resistance, (increased fasciculation creates better proprioception), enables the brain to better identify, and send a more correct neuronal signal to all the muscles involved throughout a functional movement—not just specific isolation. We move as a whole; so ultimately, the method promotes and enhances multi-movement patterns in a more efficient way while simultaneously diagnosing the limitations. The brain wants to do what is correct. The body will do what comes easiest. Unless the brain is trained to produce better motor learning patterns, the individual cannot reach his/her full movement potential.

As an example, if the knees bow out or you have trouble maintaining medial arch awareness when initiating a swing movement, the unstable service and feedback given the brain through pliable harness AND the pliable discs, allow for adjustment to ground reaction forces which isolated stretching CANNOT accomplish. Simply holding a non-pliable spacer between one's hands DOES NOT, create rotation against resistance.

The inherent benefit of the method is specifically addressing asymmetry; it is important to note that there are typical contributing factors that lead to tension presenting more on one side than the other. These can include: left-to-right pelvic rotation with the center of gravity stuck in the right hip and poor breathing mechanics causing the diaphragm to pull into the right low back, where it has a thicker, longer right lumbar-spine attachment.

Asymmetrical low-back tension can also exacerbated by an athlete's sport, position and hand dominance. Using baseball as an example, consider how the movements of the following players would add to right low-back pain: a right-handed batter, a left-handed pitcher, and a right-handed catcher, who stays on his toes due to an inability to create a posterior pelvic tilt. Consequently, when developing a program for an athlete with a low-back issue, the postures you select and the cueing and emphasis need to take into account the asymmetrical nature of the athlete's tension and corresponding compensation patterns they've developed as a result of their sport. The method of invention does exactly provide for this evaluation.

However, when the body's function determines the efficiency of a performance, or effective rehabilitation, it's probably not in the best interest to waste time with anything that's "inadvertently" good for you and could possibly be detrimental. The method of invention seeks to understand each individual's neuromuscular limitations, then provide the unique and functional mobility, breathing biomechanics, which do not over emphasize flexibility. Treating the body as a whole, functional rotation against resistance allows for more functionally specific daily living movements, better functional rehab protocols, as well as sport or position specific movements which will enhance technique.

Every joint in the body has a group of smaller core muscles which; if not strong, will create an unstable joint. If these small core muscles are weak, the brain will select larger muscles to compensate for movement and the smaller muscles become even weaker. The method of invention was designed with this neuro-physiological flaw in mind. It takes specific functional rotational exercise against resistance to train these smaller muscle groups around the joints of rotation in the hips, neck, shoulders, ankles, and wrists.

Furthermore, it is not only concerned with single movements of rotation, rather the multiple muscle activation and inhibition of functional rotation with regard to overall development of coordination in any pattern of movement, performance-technique and specific position.

Rotation against resistance exercises give the individual, especially one with disabilities, the opportunity to improve functional coordination and movement, as well as enhance mental focus. Most everything in daily life involves some expression of rotation. It is not enough just to train for an activity, or sport or rehab. Rotation is the basis of all coordination and has not been expressly developed until now.

The brain communicates with the muscles to create fast, efficient athletic motion. The method of invention, through each drill sequence, emphasizes the importance of having all muscles working in a balanced position. Only with a more perfectly structured position, while inherently promoting better posture, can the benefits of neuromuscular training be more advantageous. The invention described herein promotes this movement specific, neurophysiologic phenomenon more than any other system of exercise.

Any time an imbalance in movement is repeated regularly, the muscles will become imbalanced moving front to back, side to side or in rotation. Simply stated, the method of invention with the proper sequence of neurophysiologic drills, involving proprioception with functional rotation against resistance, is the most unique, all-inclusive method allowing for developing proper structure, balance, mobility, all principles of correct activation/inhibition in proper body positions; subsequently improving body awareness, for specific body positions.

The method of invention, prescribed rotations against resistance, through utilization of the elastic band and stick, while performing each drill on an unstable surface, improves the summation of forces principle [neuro-muscular facilitation] allowing for the unique improvements in activation/inhibition of muscles, producing more biomechanically correct positions, with increased stability, mobility, coordination, while reducing the physical limitations throughout any functional rotational movement in the body.

Participation in any sport requires the individual to better condition himself. Not all conditioning techniques are created equal, though. How the athlete undertakes conditioning determines the degree of success achieved. Most people consider sports performance a technical skill, rather than an athletic event. This is a huge misconception.

Working on conditioning for any sport through strength, cardio and core programs, many athletes will generally feel better, but are still discouraged when there is little to no improvement in the consistency of their performance. Subsequently, most athletic conditioning programs are inconsistent or left abandoned; the athlete will turn to practice, running, jumping, swimming throwing, shooting etc., to get in "game" shape, still without addressing the sport specific requirements of participation. When athletes train using exercise programs based solely on weight training principles, there is a sedation of the nervous system's ability to create proper kinematic sequencing—the coordination of multiple movements for required of the respective sport.

The athlete, training with the method described herein, can utilize a validated and scientifically designed program, which improves the integration and synchronization in the body's ability to perform specific movements.

As set forth herein, the present method is based upon the principles of neurophysiology; the specific functional exercises are designed to restore balance, flexibility, strength and coordination of sport specific movements. There is no such thing as "muscle memory", a term woefully abused in sport terminology. The brain controls muscles and doesn't think in isolated terms. Rather, the brain recruits groups of muscles in uniquely programmed sequences. It is like a computer; therefore, it needs to be programmed correctly for OPTIMAL EXECUTION of information. Correct programming with the proper sequence of drills provide the movement skill needed to improve sport-specific function. The present invention can then integrate the improved body movement into a specific sport technique with respect to:

a) Balance;
b) Flexibility;
c) Strength;
d) Sport Specific Motor Learning Development;
e) Correct Muscle Activation and Inhibition; and
f) Proper Bio-mechanics Furthermore, athletes come in all shapes and sizes, with differing levels of abilities, skill and fitness levels. No two individuals are alike. An athlete's ability to acquire the necessary positions will be a direct result of the proper implementation of the drills and movements described herein.

Think of posture as the physical manifestation of the organization of body parts as dictated by the interaction of the brain, central nervous system and musculoskeletal system. Maintenance of postural equilibrium requires sensory detection of body motions, and integration of sensorimotor information within the central nervous system, resulting in execution of appropriate musculoskeletal responses. All of these processes are vital for producing or "feeling" a more fluid movement technique.

The position of the body in relation to gravity and its surroundings is determined by somatosensation, proprioception, kinesthesia, and postural balance inputs. Somatosensory input provides information concerning the orientation of the body parts to one another, and postural control. Proprioception, as discussed above, is a specialized sensory modality of touch that encompasses the sensation of joint movement (kinesthesia), and joint position sense. Working together, somatosensation and postural balance utilize sensory input related to movement and posture form peripheral sensory receptors; muscle, joint, and cutaneous receptors. These organs detect the sensations of touch, pressure, vibration, and tickle—tactile sense proprioceptors. The senses of position, velocity, and tension, are what determine the relative sport specific positions and movement rates throughout all movement technique phases. These receptors are found abundantly throughout joint, muscle, connective and ligamentous tissues.

Just as there is static and dynamic balance, so too there is static and dynamic posture. Static balance and posture for a sport is standing or assuming the starting position while maintaining the center of gravity within the body's base of support. Dynamic posture for sport is the balanced state of forces acting on the body's center of mass—maintenance of the instantaneous axis of rotation of all working joints throughout other performance phases from start to completion of performance. This dynamic posture takes place while the athlete is trying to maintain a center of gravity over the base of support. This requires equalization of forces and optimum alignment of joint segments throughout all technique phases.

For the athlete, it is important to understand the difference between static and dynamic posture and how, if not properly understood, major inconsistencies in technique will result. It is important to understand that a poor postural setup contributes significantly to a poor performance, increases the risk of injury, and causes a whole host of improper biomechanical compensations throughout each movement phase. It is just as important for athletes to understand that proper posture alignment alone doesn't guarantee the same postural parameters as they address the starting position and then perform to completion. The postural mind—body process is part of motor memory of previous experiences of the same given task—performing full sports' movements. Therefore, it becomes clear that any discussion of balance must concern itself with achieving postural awareness through proprioceptive training.

An athletic setup position is one in which the athlete is balanced and relaxed with weight distribution (specific to the respective sport) in relation to the feet. The shoulders and trunk "erect" stacked from the hips at about the same width. This is the most consistent setup for a neutral spine, and proper balance upon which to initiate movement.

The average athlete will exhibit poor abdominal control in setting his stance. An unwanted arched, or hollow, back will cause improper mechanics; such a posture will compromise balance, decrease the amount of abdominal tension, and cause the chest and shoulders to lift. These distortions will create additional, unwanted physical compensations throughout the upper back and scapula region, affecting optimal alignment.

It is imperative, therefore, that posture and balance at any starting position become the primary building blocks since it they are precursors to and effectively dictate all other sport specific movements. Understand, each individual is uniquely different in body type. Therefore, when discussing the stance position, it is imperative that these individual differences be taken into account from a cause and effect relationship.

In concert with ground reaction forces, the stance and posture provides the initial basis for the kinetic chain and summation of forces necessary to maximize full and efficient performance throughout the event. The correct starting position places a pre-load stretch upon the muscles creating a coiling motion against the joint structures involved, preparing them for greater kinetic energy buildup and proper sequencing of subsequent release. It is important to note that almost all sporting events are a competition of "feel", meaning—there are specific physical cues one can use to assist in the proper start through to full completion of any event.

With that in mind, it is easy to understand that while there is a so-called perfect model for a sport, it is NOT attainable in the same way or same motion given the individual differences amongst athletes. If individual differences in physical movement patterns are addressed, the best we can hope for, which is better than anything to date, is that the athlete will understand and feel the correct movements possible.

It is important to focus on the torso which is generating power from the torque placed on it through any sports movement. There is a retardation phase which is directly attributed to the change in direction of the horizontal couple that the feet exert against the ground, AND, is marked by significant changes in muscular activity. Therefore, if balance is compromised at the start position, it also will be compromised through initiation of movement and ultimately through completion of the event. Hence, the multiple movement compensations associated with poor mechanics all start with stance and posture. The proper setup is the first key to proper motor learning as it relates to any sport.

The set position, or ready position is the final preparation phase before placing the body with head and shoulder alignment in place. To accomplish this, it is most important that the athlete properly sequence setting of the feet, knees, hips, the shoulders, and the head. Only then should the athlete "feel" the set position. Feeling, for a second or two, this set position, balances the forces exerted on the body, and improves the kinematic sequencing of the entire movement. There is a huge amount of feel associated with each of these phases. This makes motor learning even more effective when performing the drills since this feeling of intensity and strength are derived from the trunk and lower abdomen.

These physical cues are what we, as teachers, are trying to train the athlete to feel. This is the second part of the motor learning development taking place. If the athlete cannot get to the positions being asked of him, more likely than not, there is a physical limitation that presents somewhere in the overall movement. This will prevent the athlete from attaining the best possible positions for his or her body type.

The initial movement/motion actually starts at the setup position and will continue until the loading position for any sporting event. This loading position is truly sport specific and needs specific attention appropriate to that particular sport. This is the biomechanically strongest position to be determined per individual with regard to the specifics of his event. This subsequent movement sequencing is another part of the kinematic chain which all starts with posture, balance and the ability to create correct angular motions.

It should be obvious by now that whatever goes on leading up to the start of the event will dictate the initial movement, through to completion. So whatever the athlete believes starts the movement, the bottom line is that the ground reaction forces to the body will create the recoiling effect upon which the body feels posted. If the feet move, slide, heel/toe leaves the ground earlier during the positions leading up to start of event, there will be a loss of kinetic chain summation. The athlete may recover but some power is lost, and mechanics can be altered depending upon level of ability and fitness.

The athlete is a perfect example of the kinetic chain in action. The legs, hips, torso, shoulders arms and hands produce the speed and trajectory of body, or thrown object, if all are working sequentially. This kinematic sequence is very difficult to attain, almost impossible for amateurs, without training sport specifically. If the kinetic sequencing is altered, then the actual mechanics utilized during the event will be altered through compensations unconsciously adopted to adjust for mechanical errors made by other body segments.

Utilizing the movements described herein with respect to the present invention will increase proper coordination of this process. It will allow for a more gradual and natural summation of forces to take place consistently through proper muscle sequencing, by reducing the limitations that present in all phases of the sport.

Training for sports should be a balanced activity with regards to net muscular output from each side of the body. There needs to be a synergy in muscle balance, flexibility, strength and endurance in the shoulder girdle, scapula and chest muscles, erector spinae muscles, internal and external oblique muscles, the hips and the lower body to create the desired results while fighting gravitational forces. In other words, because of the angular movements and forces created, the static balance positions at address are now undergoing significant changes to accommodate the dynamic balance required to maintain stability and overall body position from the start through completion of event.

Failure to maintain proper angles has been found to be responsible for producing dramatic levels of stress. When compression, speed and rotary torque combine together to act on a particular joint, a great deal of stability and strength are required to withstand potential detrimental forces. If the typical athlete loses his base of support and balance during his performance, he will be forced to initiate a complex series of compensatory moves in an attempt to adjust. This not only alters angular mechanics producing inconsistencies, it also places the body more at risk for additional stress to the joints involved.

A follow through in any sporting event is a reaction to the summation of body forces leading up to the release of energy through a balanced finish or completion of event.

An example is golf, being a bi-lateral movement sport. The same shoulder and trunk action in the backswing is reversed to accommodate the follow-through in order to decelerate and stabilize the body. The left shoulder moves away from the body's midline and outwardly rotates. The right shoulder moves down and inwardly rotates across the chest. Once the arms reach about shoulder level, the elbows begin flexing in an effort to decelerate the arm speed and trunk rotation, minimizing vertical translation, while assisting in maintaining balance.

Other sports are no different. To achieve an efficient follow through position, there must be a controlled completion to finish through the forces exerted on the body. The energy of the body must be balanced to achieve fluid motion.

During any follow-through the body, still fighting to maintain holding intensity, balance and stability, must also maintain core strength. Because rotation and angular motions continue to occur throughout the entire event, from start to finish, there is high bilateral activity in the erector spinae, abdominal oblique, and synergistic muscle groups. When forces of the body's motion become ideally centered or "stacked," these muscle groups are needed to control balance and posture against vertical gravitational forces. As the body attempts to decelerate its rotary and angular motions through eccentric muscle contractions, all muscle groups that are strategically involved in the event should be working as one.

Any deviation from this is usually a result of improper body mechanics. Therefore maintaining posture and balance throughout all technique phases is a skill that requires continued activity of the stabilizing muscles of the trunk. Since the finish position is a by-product of the previous rotational and angular phases leading up to this point in an event, much can be learned from the actual follow through and finish positions.

If the athlete does not maintain posture, there is a loss of balance and the finish position is compromised. This end result is caused by the body seeking to re-balance itself throughout the entire event. The body will always figure out an appropriate compensation. It will do what comes easiest, not necessarily what is correct. So at the finish, the athlete will actually give clues as to what may have gone wrong in one or previous performance phases.

Maintaining body control is achieved through being aware that all body parts have to be connected as one. The strength to hold and control the powerful forces exerted on the body throughout any event come from within the trunk. Also, there needs to be conservation of motion, the body conditioned to conserve as much energy as possible. These attributes add to the beauty of the sport. They can be uniquely achieved through the development of motor programs utilizing sensory organization to determine timing, direction, and speed of correct postural actions, and muscle coordination to generate and execute corrective motor responses with respect to sequencing and distribution of contractile activity in sport specific muscle patterns. Ineffective sequencing or improper coordination will result in loss of posture, balance, and body awareness which degrade performance.

Training with the movements described herein will allow for more rapid development of these attributes toward improving performance technique. Each muscle group has a specific skill to perform. Once the basic skill set is learned, only then can it be integrated into the whole, improving performance. Then with proper, more sport specific practice, the refinement of technique becomes more "practically" integrated into a more efficient performance. It will become more automatic with fewer unwarranted and invasive negative thoughts. The proper mental understanding of how the joints and muscles of the body work together to perform the event is more easily attained. Basically, you have to understand and believe in what you do before you can do it.

The present invention is based on the neurophysiology of how the brain controls the muscles, joints, and all soft tissue of the body. It is the brain that sends the message to move. The importance of this to motor learning in an approach to create a more efficient performance cannot be overstated. Simply put, specific muscles move specific joints in a specific way. The kinematic sequence is being trained more efficiently. Faulty performances are a direct result of some incompletion, interruption, or omission of the movement message from the brain to the anatomy involved in the completion of the sport.

The improvement of the brain's software will provide a better pathway to deliver improved motor commands. Over time these commands will be more consistent, resulting in fewer physical limitations. The specificity of the movements described herein essentially means that the training may be biomechanically to the specific to the demands of a particular sport.

This "selective" stretching method through is a process whereby the overall function of the individual may be improved by applying selectively sequential stretching to some muscles and joints but allowing limitation of motion to develop in other muscles or joints. This is unique to the sequential selective drill sets described herein.

The drill sets described herein through the "combination" functionally based diagonal patterns of sequential movement techniques to initiate neuro-muscular facilitation and evoke specific motor responses through specific rotational movements against resistance. The result is to evoke specific motor responses to improve neuromuscular control and function across multiple joints/muscles simultaneously.

The application of the present invention uses specific patterns of movement in specific rotation against resistance which increases oscillations that provide increased sensory cues in vestibular, proprioceptive, cutaneous, and tactile stimuli enhancing spatial properties, especially in deep receptors that have larger receptive fields and respond to vibrations within the specifically positioned movements. The result is increased plasticity in neural functioning leading to changes in how cortical cells are allocated to body parts. Multiple muscles across multiple joints are therefore training more efficiently and simultaneously with the movements described herein.

Embedded in the method described herein, is the approach that stronger muscle groups of the specific sequenced movements in rotation against resistance, facilitate the responsiveness of the weaker muscle groups. All done across multiple joint-muscle movement in more functionally specific and biomechanically correct sequences.

Since the patterns of movement are composed of multi joint, multi-plane, diagonal and rotational movements of the extremities, trunk, and neck. The patterns are identified by the motions that occur at the proximal pivot joints motions such as flexion and extension of the shoulder or hip which is coupled with abduction or adduction as well as external and internal rotation. Since these motions occur simultaneously during each movement specific sequence the coupling patterns are more effective.

Research shows that gains in flexibility and range of motion achieved as the result of a standard stretching program are transient at best, lasting only a few weeks after cessation of this standard program. The present invention has proven that the most effective means of achieving "permanent" increases in range of motion and reducing functional limitations is to integrate "functional movements" into the stretching program. Inherent in all of the drills are "combined" movement of the upper and lower extremities and or spine that are components of daily activities including, for example, grasping, reaching, turning, twisting, pulling, bending, pushing and squatting.

The ankles, knees, hips, pelvic girdle, lower body trunk, thoracic spine, shoulders and head are "all" working through each drill position. The activation and inhibition theme is the key with stability through the core, correct posture, allowing for most effective "kinetic" chain experience.

The sequential drill sets also include these type exercises while in correct biomechanical positions. Utilizing unstable surfaces, creating oscillations through destabilizing the body and enhancing the oscillations through the use of pliable elastic toners and harnesses, the movements are much more efficient, engaging a higher percentage of neural firing through the entire functional moves of the body.

So this is where the present invention comes into play. It works on positional stability, with a changing force vector increasing positive effects of neuro physiology, to help you maintain the position in the presence of greater fatigue. Doing exercises like this that actually challenge the stability of the total work load really well.

Because many of the positions require multi-planar movement in a controlled manner or positional hold, demanding perfect alignment in those poses forces students out of compensation patterns. Taking them out of these patterns activates muscles that have been dysfunctional dormant, and inhibits the overactive compensators (effectively turning off the tension). It's the activation and inhibition initiated, not just stretching, that actually helps students become more mobile. By destabilizing the body and creating higher oscillations through each drill set, the brain is hard wired to deliver proper sequencing.

The present invention looks to create a neural response to training, by working on some of the spinal reflex loops that produce these involuntary contractions, which usually occur with a higher amplitude and faster rate of contraction that conscious thought normally produces.

The present invention can also identify the contributing factors to areas of chronic tension and leverage the method to concentrate on specific activation of the muscles that have been inhibited (agonists and synergists) by the tense area's over activity/compensation. In this way, you use reciprocal inhibition to not only relieve tension but restore kinetic chain firing and functional range of motion. Stretching, alone, can't accomplish that.

The position of rotation against resistance actions, (i.e., vibrotactile effectors) takes the form of vibration response to touch with multi-touch input through elastic harness, and/or elastic tubing fixated to spacer to provide vibratory feedback, when a user makes contact with the unit. More specifically, the movement patterns provide for an individual to induce a feedback vibration through multiple muscles across multiple joints in biomechanically correct rotational positions. Feedback from the pliable discs (or other pressure deformation) on the feet and creating a pressure sensation on a user's hands, along with rotation against elastic resistance, provides tactile and neural feedback to individuals as they perform each drill. As the individual makes a rotational movement against elastic resistance, they feel mobilized across multiple joints/muscles throughout the kinetic chain of the entire body.

Tactile vibrations closely mimics manual palpation, through the elasticity of the harness and smart stick-toner. This pressure in position deforms soft tissue through the inherent tensile properties of equipment. The cells within this soft tissue have the ability to remodel damaged or used tissues to adapt them to the stressors applied, thereby detecting resulting changes in the pressure patterns of all movements across multiple joints/muscles in position simultaneously.

The present invention can work off of these spinal reflex loops to create increased or even decreased mobility in the entire body.

This increase in neural drive in a protective manner caused a reflexive relaxation following the activity, which helped to increase range of motion. It also helped reduce protective guarding by increasing muscle activation around the spine. The muscle being worked on itself wasn't the keystone to producing new range of motion, but the systemic application of a neural stressor that the body had to adapt to, one way or another.

These exercises are designed to address the active performance of precise joint movement including intra and inter-joint, within limb segments and total body motion. Consistent with kinesiology one part of the body cannot move during activity without being impacted by other parts or without impacting other parts of the body. Additional exercises for improving abdominal muscle performance further enhance the stability control. The patient is also instructed in correct spinal motion or prevention of motion during functional activities. For example, with knee or hip pain the motion of the affected joint has to be corrected such as hip adduction and medial rotation during going up or down stairs or even sit to stand. In the case of back pain, most often the movement of the spine has to be restricted and the patient taught to move in the hips. This is the essence of the drill sets described herein.

Also, the average individual will exhibit poor abdominal control in establishing their initial setup before performing any exercise. An unwanted arched, or hollow, back will cause improper mechanics; such a posture will compromise balance, decrease the amount of abdominal tension, and cause the chest and shoulders to lift. These distortions will create additional, unwanted physical compensations throughout the upper back and scapula region, affecting optimal alignment. The utilization of pliable discs, in kneeling, seating, lying, standing and all staggered positions, allow for more stable trunk control while performing the multi-plane rotational drills.

All of the exercises can be considered movement pattern training with the focus on not only the joint that is being exercise, but also on the body region to which the joint belongs and to total body movement during functional, work, fitness, and sports activities.

The primary difference of the approach of the invention is the emphasis on both stability and mobility through precise training of movement patterns during active motion. Though many of these exercises can be considered "open chain" that is—to enable the patient to learn to find and use the deficient muscles. The belief being that impaired movement patterns do not use all muscles optimally and that if the muscle cannot be activated under optimal conditions, such as during the specific exercise, it will not participate during general movements.

At the same time the patient is instructed in precise or correct performance of basic movement patterns of daily activities. Any movement training in the absence of some form of motor pattern re-education may be a limited benefit to the patient as the proprioceptive elements can just go back to where they were before, leaving them tight again in a couple of hours.

The present invention can also be used as a definitive rehabilitative mobility technique that is designed to facilitate the body's natural healing process while providing support and stability to muscles and joints without restricting the body's range of motion, as well as providing extended soft tissue manipulation to prolong the benefits of training.

The method is a therapeutic mobilization technique not only offering individuals the support they are looking for, but also rehabilitating the affected condition as well. By targeting different receptors within the somatosensory system, the neuro-physiological benefits have proven to help reduce pain and facilitates stability, mobility, coordination and strength through enhanced ranges of motion, by working in correct biomechanical positions, across multiples joint/muscle actions, in biomechanically correct rotational positions simultaneously.

Mobility is one of the concepts of fitness thrown around with a variety of descriptions, means, and methods for improving or using it without understanding whether that improvement is necessary or even possible. One potential definition of mobility is the available range of motion of a joint in a specific direction. Another is the available and usable range in a specific movement. Another is a global ability to move through a range of motion. Yet another could be the length of a muscle. These can all have similarities, but are in themselves very different from each other.

Joint mobility as defined by most medical dictionaries is the ability of a joint to be moved through its range in different planes. This is dependent on the characteristics of the individual joint itself as well as the supporting muscles and ligaments the capsule and the anatomy of the articulating surfaces.

Flexibility or limberness as defined in most dictionaries refers to the absolute range of movement in a joint or series of joints, and length in muscles that cross the joints to induce a bending movement or motion.

Both of these definitions could define what is also known as passive range of motion, or what is accomplished with minimal feedback from the individual and not subject to their conscious cues. Active range of motion is how much range the individual can move their limbs through with conscious commands. For instance, to assess someone's hamstring flexibility with a passive straight leg raise, you are looking at how much range of motion they have through their hips in flexion. An active version is having them raise their leg up to see how much flexion they can use on their own in that direction without outside assistance.

In many instances, the passive range of motion achievable in any joint will be greater than the active range of motion that could be achieved. Much of this is due to the limited contractile ability of any muscle in its most shortened position.

Obviously, one can see that active tension drops off significantly before the end of the available length of the muscle, and that the remaining tension applied in the joint is due to stretch through the ligaments and joint capsule, not necessarily through the muscles that would move the joint into that position in the first place.

There is also the concept of insufficiency to get into this position, usually mediated by either passive insufficiency or active insufficiency. In passive, you just do not have the length to allow entry into that range of motion. For example, trying to do a straight leg flexion compared to a bent leg flexion. If the straight leg is reduced but the bent leg raise is huge, there's likely a passive insufficiency through the posterior chain muscles of the low back, glutes, hamstrings, and calves. An active insufficiency is an inability to produce muscle force to enter into that length.

Another example is using a knee flexion mode for something like a quad stretch. A passive insufficiency would mean you couldn't grab your foot and bring it to your butt because something's resisting it. An active insufficiency would be an inability to contract the hamstring to replicate that position effectively, or at least get close to the passive component.

So far we've only looked at the potential range of motion available with no influence of outside variables, and/or the potential loss of range to some physical limitation. The approach has always been to utilize the following analogy: Instead of looking at the hardware aspects of mobility, more time is spent looking at the software. The brain and peripheral nervous system is one of the largest determinants of mobility there is, and understanding it and using it effectively can be the difference maker in having a mobility program that works and one that does not.

The brain controls both conscious and subconscious muscle tension and reflexive contraction and relaxation. In patients under anesthesia, some studies have shown immediate increases in joint range of motion once neural input is removed. Cerebral palsy commonly comes with hemispheric muscle spasticity, meaning the muscles are chronically "turned on low" and in a shortened position. A condition known as heterotropic ossification develops on the affected side of people with hemispheric cerebral and cerebellar disturbances, but not on the unaffected side, and winds up reducing range of motion through those affected joints significantly.

Coma patients, even the very elderly and degenerated, can commonly have massive joint ranges of motion through their hips and spines with zero neural input in to them. Paraplegics can suffer from contractures, which is a shortening and fibrotic stiffening of the muscle tissue with disuse and seated postures, but can still have spasm contractions from the muscles in response to changes in joint angles and velocities. Occasionally these spasms are oscillating wave-like spasms or twitches that increase and decrease in both amplitude and frequency, and sometimes they're just consistent twitches for a few seconds or minutes, and others can be full on tetanized contractions that last for a long time.

These spasms are entirely devoid of central input and are likely due to spinal reflex loops that cause the muscles to contract in response to something. A classic example of these spinal reflex loops is the knee jerk response to tapping the patellar tendon with a rapid force, as used by doctors with a rubber mallet to test reflex speed.

We can work off of these spinal reflex loops to create increased or even decreased mobility in the entire body.

This increase in neural drive in a protective manner caused a reflexive relaxation following the activity, which helped to increase range of motion. It also helped reduce protective guarding by increasing muscle activation around the spine.

A similar reaction to increased neural stimulation can be seen here, where scraping the masseter in a painful manner causes a big spike in neural impulse through the entire body, and removal of the stress caused a reciprocal reduction in protective tone, sort of like when a massage therapist digs into a tight knot and when they're done you feel more relaxed.

The muscle being worked on itself was not the keystone to producing new range of motion, but the systemic application of a neural stressor that the body had to adapt to, one way or another.

This is one of the main outcomes of the autonomic nervous system, the "fight or flight" system that causes increases in neural, endocrine and cardiac outputs to help you respond to stressful stimuli to help you either defend yourself or run away from trouble. If you're in a ready and low anxiety state, your passive and active range of motion will be better than if you're in a stressed out or anxious state Activities that promote more parasympathetic stimulation also tend to produce range of motion increases compared to control. Yoga, tai chi, qui gong, and meditation all use methods of breathing that have been linked to parasympathetic stimulation, and these breathing techniques are also favored by dancers and gymnasts to get into very deep stretches.

The main method of consciously stimulating the parasympathetic system is through long, slow and deep breathing, both inhaling and exhaling. With the present invention, alternating stretching and mobility with rotation vs. resistance and taking a period of time (which may be five seconds or more (total of 20 seconds) to inhale, long and smooth, and then exhaling for up to 5, up to 8 and even up to 10 seconds per breath. The exhale is more of a release than an expulsion of the air. Doing this breathing for a minute or two can have massive effects on neural drive through the body, and also on mobility. Couple this within the inherent sensory benefits and increased neural drive of the drills, the overall central nervous system is enhanced.

For the vast majority of treatment modalities designed to see increases in range of motion of a tissue or joint, much of it comes from alteration of the neural input to the tissue. The present invention is specifically based on increased neural input, in correct biomechanical positions, while under the challenges presented through stabilization inherent in each exercise, and position.

There are other techniques like dry needling or acupuncture work on stimulating myoreceptors to induce a spasm response and again alter the neural tone of the tissue. High velocity low amplitude (HLVA) adjustments common in chiropractic treatment do something similar by rapidly altering a joint position and causing a proprioceptive response in the tissues. However, one criticism of this approach is that the adjustment in the absence of some form of motor pattern re-education may be a limited benefit to the patient as the proprioceptive elements can just go back to where they were before, leaving them tight again in a couple of hours. The method described herein does stimulate myoreceptors to induce neural tone, the difference bring the specific motor patterns of re-education are inherent in the method, thereby creating a longer lasting proprioceptive affect In working with patients with mild to severe post surgical or post injury scar tissue, breaking up this scar tissue tends to take considerable force and recovery modalities, like manipulating a total knee replacement under general anesthesia to restore post-surgical range of motion if the individual didn't maintain mobility and activity.

In about 1.3-13.5% of patients who receive a total knee arthroplasty, they may see significant and painful reductions in joint range of motion due to operative scar tissue formation, meaning they have to undergo a manipulation under anesthesia. You could imagine the process would be pretty painful, which is why it's done under anesthesia.

This scar tissue reduction is not something that can easily be addressed with a tool assisted therapy, but realigning scar tissue fibers themselves can be assisted with different tools and force applications. By working the joints it can help to reduce the haphazard manner of scar tissue formation and make the fibers of collagen line up more with the directions of force application, meaning range of motion is usually maintained. This is another key component of the research and development behind the method described herein.

The present invention with unique proprioceptive characteristics, is primarily concerned with the influence our SENSORY input is having on our muscle tone, and our overall health. Through structured drill sets involving rotation against resistance, the method provides a feedback loop that allows you to feel errors as they occur and correct them, unlike any other training program. The feedback matters and the concentration as well.

Through method described herein, the immediate proprioceptive feedback seems to boost the mind's processing speed, strengthen synaptic connections, and expand or create neural networks for what we are practicing. However, as one masters the execution of a new routine, repeated practice transfers control of that skill from "over thinking" and mechanical to a more natural performance that eventually make its execution effortless. At that point you don't need to think about it, you can do the routine well enough on automatic. This enhanced motor learning, brain-body feedback loop has significant application to sports, rehab, disabled veterans, and aging populations.

Most applied kinesiology is based on individual muscle tests, basing the testing on, and then building a technique around the significance of individual muscle weakness.

The trouble is that humans do not move using individual muscles. They move using whole-body muscle reactions, many of which that involve some aspect of rotation. In fact, unless part of the body is stabilized against something solid, almost every muscle is potentially involved in every movement. This is why it is important to work these muscles as a functional unit to enhance quality of life. Functional movement skills, designed around functional rotational skills, designed around functional skills, "required" for everyday life. The present invention addresses and assists in correcting whole-body movements.

Form factor is going to be important—for any technology, especially in healthcare, for it to be successful, the following things have to happen—a) outcomes need to be there, b) needs to be cost effective, c) needs to be accessible, and lastly, d) needs to enhance the person's quality of life.

As technologies improve (sensors, mobility, body area mapping etc.), mainstream adoption can come only when these are successful in health outcomes. Getting the consumer engaged in achieving outcomes under the right health economics structure will be the key to driving adoption. Healthcare changes are coming rapidly, the present invention has been perfecting the deliverable; but is still positioned to be the neuromuscular solution to physical issues. This has been a long drawn out process. There is enough technology out there today to handle the basic preventative aspects of health and wellness and once the "physical" interactive outcomes catch up, you will see increased adoption.

Looking to understand how alternate technology environments are tackling healthcare—fabrics per se is not a direct focus for us, but there are opportunities to learn on integration, operability and adoption of data collection synced with a neurophysiologic solution to influence some of the main industries where wearable technology can have a key role and opportunity for growth.

In preferred embodiments, the present invention is directed to and offers:

A) Corrective exercises which addresses weaknesses and faulty movement patterns, which inhibit performance and undermine health. Instead of beating up your body to achieve a specific performance improvement, the present invention allows for basic fundamental corrective movement patterns. Fixing an issue like weak adductors or a tight t-spine may correct a technique mistake during daily functional activities, sports performance, rehabbing from an injury, or working to correct physical limitations through lost limbs or PTSD.

B) Activation and inhibition drills that use positional breathing to improve movement patterns, rotation against resistance to get reactive movement improvements much quicker. It's common now to see warm-ups take 30 to 40 minutes, which is excessive. The present invention is much more efficient and eliminates a lot of random stretching drills due to the higher activation of muscle tissue, an increased metabolic rate, with multiple muscle engagement, through patterns of rotation against resistance. Thereby reducing the time needed to warm up and more time actually exercising. This activation, and inhibition allows the individual to get stronger, more mobile, with increased coordination, improving sport specific biomechanics.

C) Mobility, Recovery and Regeneration that addresses the need for mobility, recovery and regeneration work for individuals of all ages. The key to attaining these results in a way that allows for sustainability and longevity is through incorporating proprioceptive neuromuscular facilitation WITH rotation against resistance. The multiple muscle activation and innervations provided by each drill, allow for the overall movement quality with balanced, sequenced patterns that focus on better mobility at the ankles, hips, wrists, shoulders and neck.

The series movements shown in the examples below specifically targeting core musculature and encourage both stability and flexibility, all while using portable and inexpensive pieces of equipment.

The equipment used in the examples comprises one or more of balance disks, smart sticks, toners, etc. It is also noted that the disks should be less than fully inflated so that they compress during the each of the series of movement that make up the exercises.

EXAMPLES

Example 1

Figure 6:
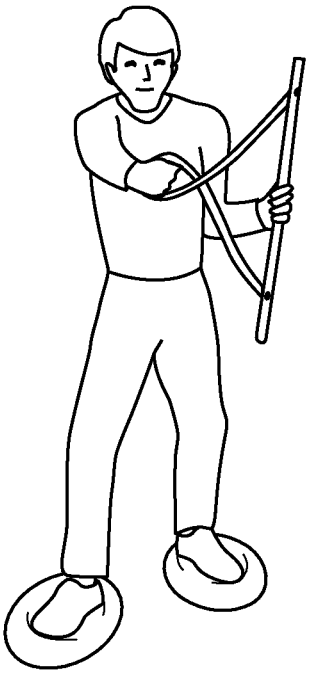
FIG. 6 depicts a view of a step in a sequence of movements in accordance with the present invention in a standing position.

An individual starts by standing on leverage discs with feet as flat as possible, knees slightly flexed and symmetrically stacked over the ankles, as illustrated in FIG. 6. The hips are square with a neutral pelvic tilt and shoulders squarely stacked over the hips. With head forward, the smart stick (coupled resistance toner and stick) is held parallel to the body, with hands placed on opposite ends. One arm is flexed at 90 degrees with elbow at the side.

Figure 7:
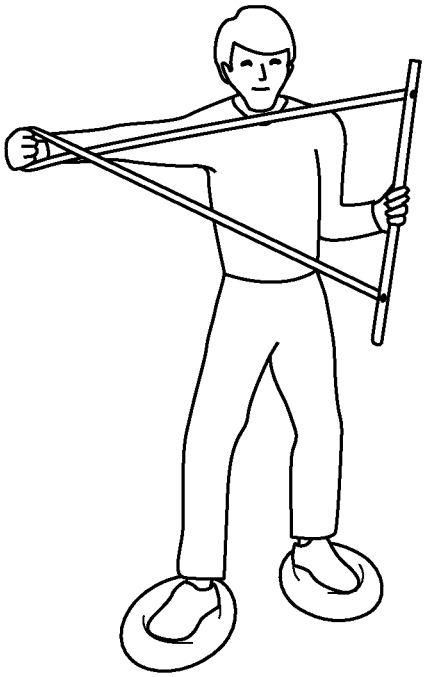
FIG. 7 depicts another view of the step in the sequence of movements shown in FIG. 6 in accordance with present invention.

With opposite hand and elbow extended, the individual reaches away from the body at shoulder height as shown in FIG. 7. The individual slowly pull the first elongated spacer out to the side motion and an opposed second motion out to the opposite side with both parallel to the floor so that a first arms extend behind shoulder during the takeaway and a second arm extends parallel to the floor, with the second spacer[stick] perpendicular to the floor.

Holding lower body position while reaching, maintaining neutral hip and spine, the individual exhales while reaching into mild tension through the back of shoulder and trunk.

The drill is repeated 5 times, and then reset. The drills are then performed on the opposite side.

Example 2

Standing position on discs, spine and pelvis in neutral. Holding the smart stick overhead with both arms extended and hands together as shown in FIG. 4 and then pull apart until arms are parallel to the floor as shown in FIG. 5.

Try to maintain neutral pelvis and spine, and still lower body, then turn rotate trunk to one side, creating only lumbo pelvic-hip turn. Exhale as you turn into position with mild tension. Repeat 5 times on each side.

Example 3

Figure 8:
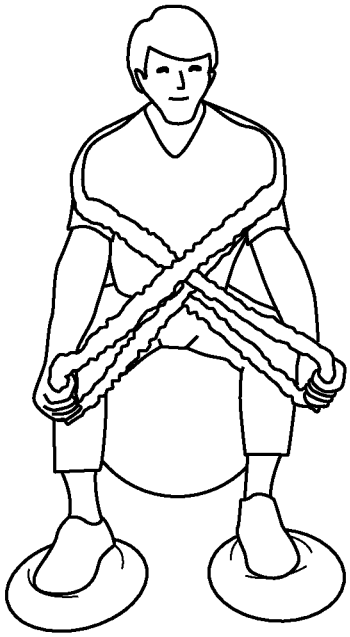
FIG. 8 depicts a view of a step in a sequence of movements in accordance with the present invention in a seated position using a harness.

Begin in seated position on physioball and feet flat on discs. Neutral pelvis and lumbar spine in slight flexion; with knees and hips at 90 degrees. With an elastic harness over shoulders, arms are extended straight in front with handles crossed as shown in FIG. 8. Keep this position while rotating trunk to one side creating mild tension.

Hold this position with legs as still as possible. Maintain pelvis and spine positions, with feet as flat as possible. Repeat movement in each direction for 5 times.

Example 4

Figure 9:
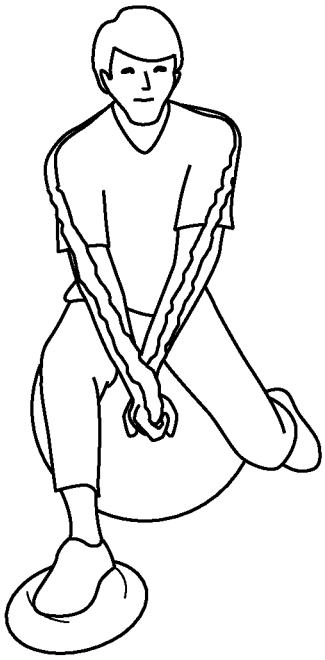
FIG. 9 depicts a view of a step in a sequence of movements in accordance with the present invention in a seated position using a harness.

Begin in seated position on physioball with front foot flat on disc; hip-knee flexed at 90 degrees. The opposite leg staggered back on side of physioball with toe pointed to floor. Neutral pelvis and lumbar spine in slight flexion. With elastic harness over shoulders, arms are extended straight in front with handles together at shown in FIG. 9. Keep this position while rotating trunk into front leg creating mild tension. Hold this position with legs as still as possible. Maintain pelvis and spine positions, with feet in original starting position. Repeat slowly, with control, 5 times. Maintain spine and pelvis positions, and keep shoulders and hips stacked while rotating.

This series of movements provides rotation against resistance wherein the design of each drill incorporates a specific sequence to enhance motor learning through training on a first and or a second and a third destabilized surface, incorporating the use of an elastic harness-like implement at least 7 inches wide by 30 inches long.

This training method trains the sensory systems within the trainee's body to improve the brain body function of proper movement patterns. Placement of the another foot on the pliable object destabilizes the trainee such that the training method trains the sensory systems within the trainee's body to improve the brain body function of proper movement patterns.

Example 5

Figure 10:
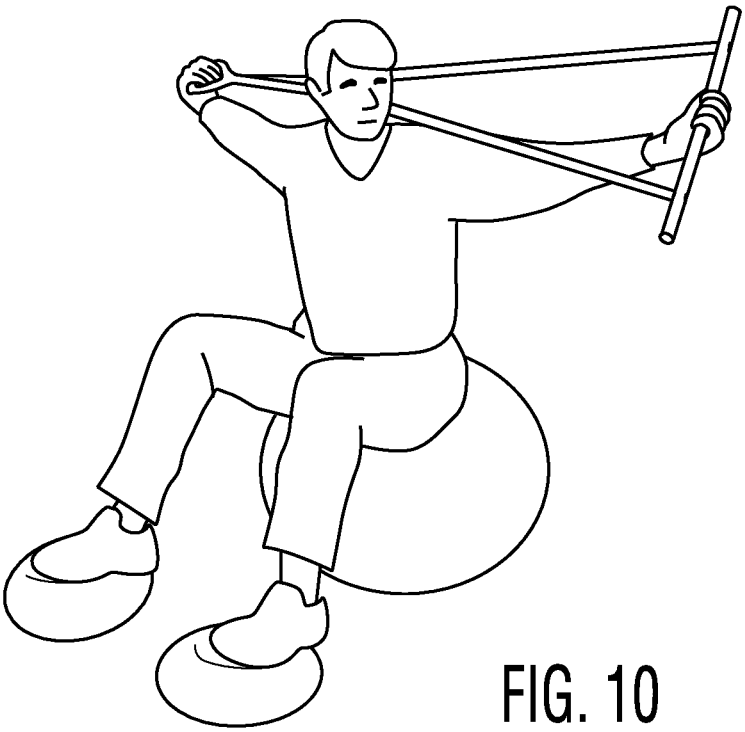
FIG. 10 depicts a view of a step in a sequence of movements in accordance with the present invention in a seated position using a stick coupled to an elastic band.

Begin in seated position on physioball with foot flat on disc; hips-knees flexed at 90 degrees. Neutral pelvis and lumbar spine in slight flexion. With elastic toner and stick over head, arms are extended straight out to sides with palms up as shown in FIG. 10. Keep this position while rotating trunk creating mild tension. Hold this position with legs as still as possible. Repeat slowly 5 times Maintain spine and pelvis positions, with feet in original starting position, keeping shoulders and hips stacked while rotating.

Example 6

Figure 11:
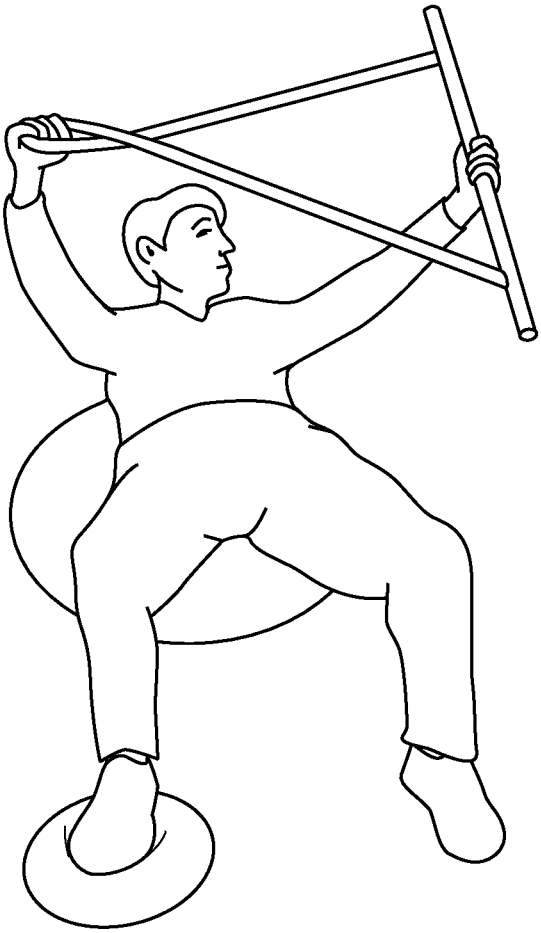
FIG. 11 depicts a view of the step in the sequence of movements shown in FIG. 10 in accordance with the present invention.

Begin in lying position on physioball with foot flat on disc; hips-knees flexed at 90 degrees. Neutral pelvis and lumbar spine in slight flexion. With elastic toner and stick overhead, arms are extended straight out to sides with palms up as shown in FIG. 11. Keep this position while rotating trunk creating mild tension. Hold this position with legs as still as possible. Repeat slowly 5 times Maintain spine and pelvis positions, with feet in original starting position, keeping shoulders and hips stacked while rotating.

Figure 12:
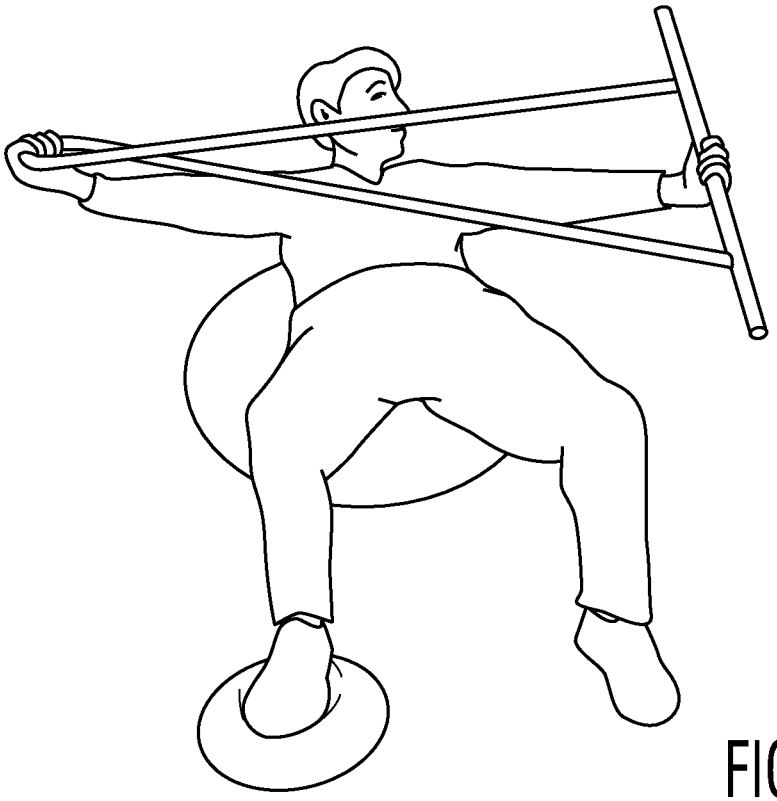
FIG. 12 depicts a view of a step in a sequence of movements in accordance with the present invention in a standing position.

Lying on a pliable surface with ball supporting the low back, front foot flat on pliable disc with knee flexed at 90 degree, opposite knee flexed at 90 degrees with foot flat on floor, back foot point perpendicular to floor. Place one hand on toner and one hand on stick with elbows extended out to front and at shoulder height, shoulders relaxed and slowly pull toner and stick apart so that elbows are in complete extension and parallel to the floor as shown in FIG. 12. Take a deep breath and exhale as you perform this move and hold position for 3-5 seconds. Example 7:

Start in standing position and perform the following movements:

1) Standing with one foot on pliable surface with foot as flat as possible and second foot on second pliable surface;

2) Both feet as flat as possible with knees slightly flexed, hips stacked squarely over the knees and shoulders square;

3) Place a pliable harness over the shoulders with one hand on the handle and opposite hand on second handle as shown in FIG. 12;

4) With first elbow flexed at 90 degrees and resting against one's torso and second elbow at 90 degrees resting against one's chest;

5) Wrists should be in completely neutral position

Figure 13:
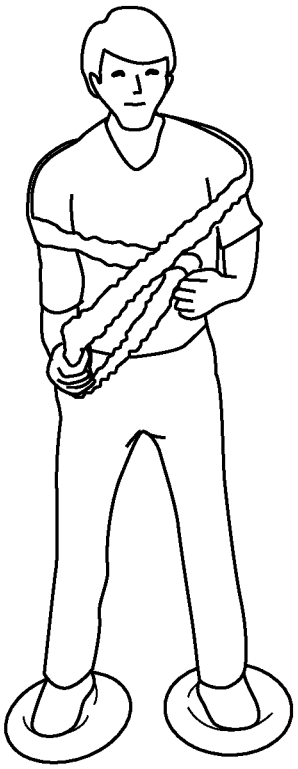
FIG. 13 depicts a view of the step in the sequence of movements shown in FIG. 12 in accordance with the present invention.

6) Shoulders relaxed and slowly pull and rotate 1st elbow out to 90 degrees keeping the forearm parallel to the floor as shown in FIG. 13.

7) Maintaining stacked lower body position with feel as flat as possible;

8) Take a deep breath and exhale as you perform this move and hold position for 3-5 seconds;

9) Perform the same stages in 4-6 and holding the alternate position for 20 seconds; and 10) Repeat sequence 5×total.

Example 8

Figure 14:
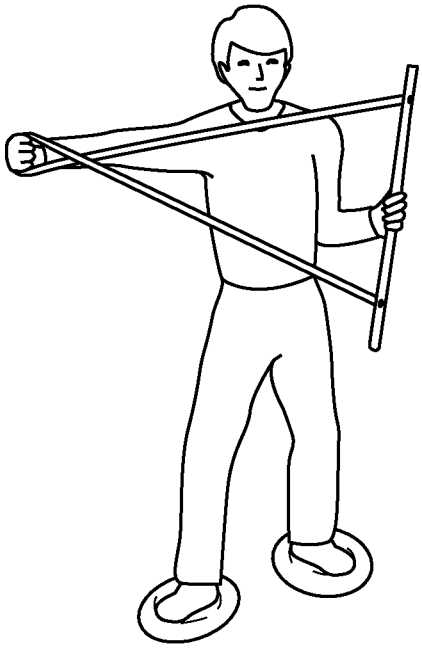
FIG. 14 depicts a view of a step in a sequence of movements in accordance with the present invention in a standing staggered position.
Figure 15:
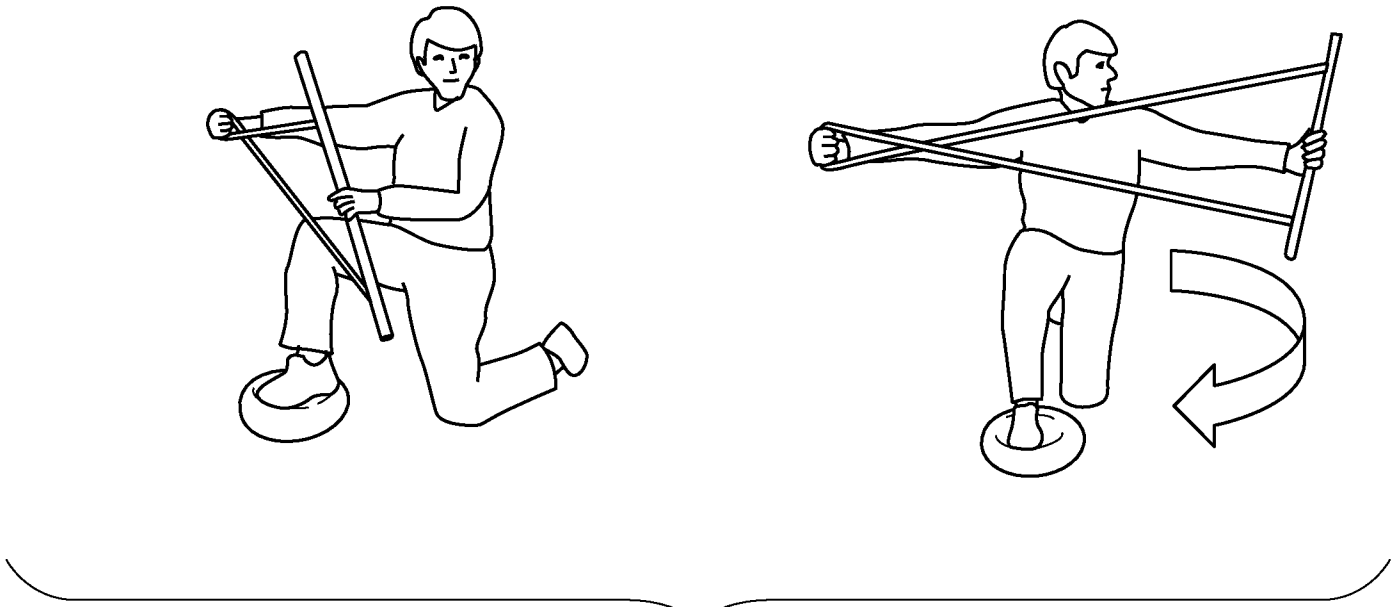
FIG. 15 depicts a view of a step in a sequence of movements in accordance with the present invention in a kneeling position.

Standing feet staggered apart placing one foot on a first pliable object positioned in a on a foot behind you, and placing another foot on a second pliable object positioned on the generally flat, level surface, said pliable object providing an unstable support for said another foot as shown in FIG. 14.

Keeping feet as flat as possible, knees slightly flexed and symmetrically stacked over the ankles. Your hips square with a neutral pelvic tilt and shoulders squarely stacked over the hips. Keep your head forward placing a coupled resistance toner and stick over one's head and gripping a first spacer [toner] with one hand and the second spacer [stick] with other hand and parallel to a floor.

Slowly pull the first elongated spacer out to the side motion and an opposed second motion out to the opposite side with both parallel to the floor so that arms are lowered against resistance to shoulder height during the takeaway and a second arm with rigid spacer parallel to the floor, with the second spacer[stick] parallel to the floor.

Removing the tension on the elastic member by bringing the second hand back into the proximity to the first hand while maintaining the elbow associated with the first hand proximate side of the body and.

Alternating performance by at least one of a stretching drill followed immediately by at one functional mobilization drill, both involving rotation of at least two joints in each of the positions described.

AFTER each stretching drill and only with each alternate mobilization drill, gently rotate to the right holding each mobilization 3-5 seconds before return to starting position.

Perform 5 repetitions repeating steps to one side then switch to the opposite side. The training method trains the sensory systems within the trainee's body to improve the brain body function of proper movement patterns.

Example 9. Half-Kneeling Position

Although having one knee on the ground seems simple, it is capable of linking up body segments, stabilizing the trunk and raising the strength ceiling of any individual. With the present method, the segment linkage is greatly enhanced along with all of the aforementioned neuro-physiological factors in EACH AND ALL DRILLS.

The half-kneeling position is considered a developmental milestone in human growth and movement. Once a baby has the ability to move from a side-seated position to a tall kneeling position (with both knees on the ground), the next phase before walking on two feet is the half-kneel. The half-kneeling position loads one hip in a flexed position while the other stays relatively neutral. For a move that is deceivingly simple to the eye, true mastery of this position yields huge benefits in performance and long term health of the spine, hips and lower body in general.

Thus, utilizing the sequential method of rotation against resistance through motor learning technique, these series of movements in a strong half-kneeling position, will enable the individual to better stabilize his hips and core; reaping the benefits of foundational rotational strength movements.

Perform grouped exercises ADDING TRUNK ROTATION both into and away from the forward foot side once stabilized on discs. For double-arm movements, alternate your grounded knee every other set. The following are examples of several sets of movements that can be performed in accordance with the invention although there are certainly many others.

A) Half Kneeling double shoulder Abduction with TRUNK ROTATION

1) Front foot flat as possible on disc, back foot with toe pointed to floor

2) Front knee stacked over foot and both hips square

Figure 16:
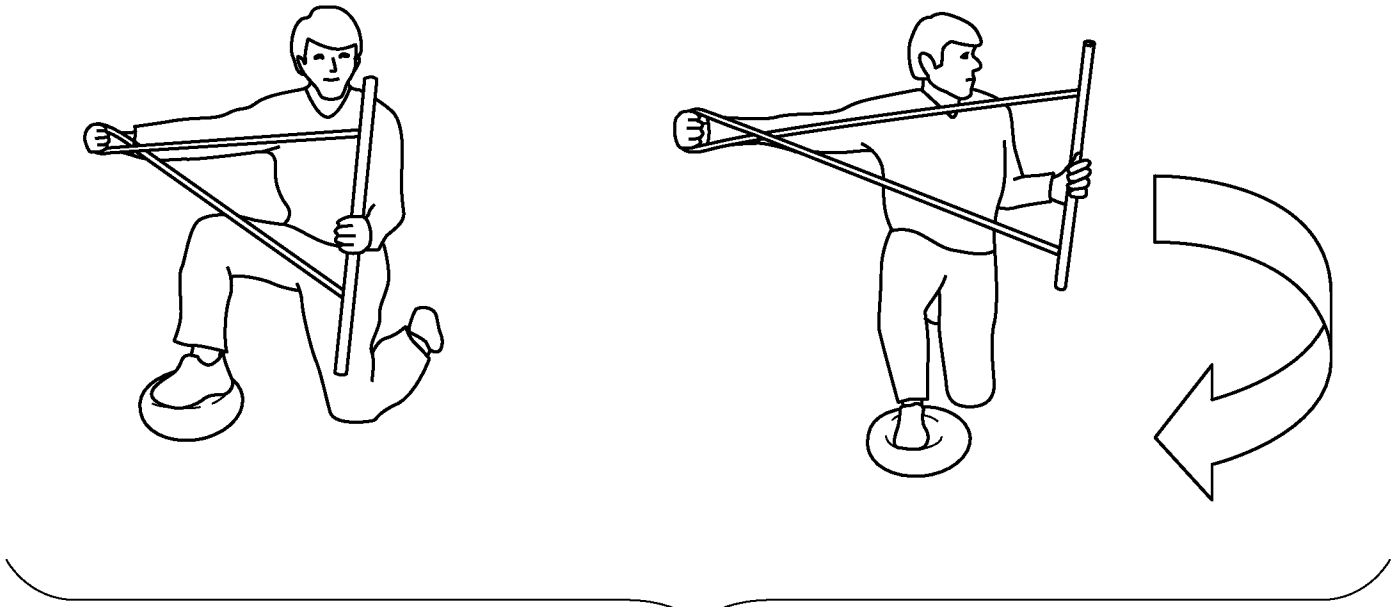
FIG. 16 depicts a view of a step in a sequence of movements in accordance with the present invention in a kneeling position.

3) Hands together with elbows straight out in front as shown in FIG. 16, then alternating.

4) Pull toner and stick apart then rotate to right with elbows locked hold 20 seconds as shown in FIG. 16.

5) Rotate to right holding 3-5 seconds and return to starting position

6) Repeat 5 times and switch to opposite side

Half-Kneeling Single Shoulder Pull. Stick elbow flexed at 90:

1) Front foot flat as possible on disc, back foot with toe pointed to floor

Front knee stacked over foot and both hips square

Hands together then alternating.

Pull toner to right with elbows locked holding stick by your side hold 20 seconds as shown in FIG. 17.

Rotate trunk to right holding 3-5 seconds and perform 1-3 and return to starting position.

Repeat 5 times and switch to opposite side.

Half-Kneeling Shoulder pull. Stick Shoulder flexed at 90

Half-Kneeling Single Shoulder ABDUCTION, Stick Shoulder Horizontal Flexion and Abduction 90 degrees to floor with elbow flexed at 90 degrees. Perform triceps extension by straightening elbow out parallel to floor.

Half-Kneeling Shoulder pull, Stick elbow flexed at 90

1) Front foot flat as possible on disc, back foot with toe pointed to floor

2) Front knee stacked over foot and both hips square

3) Hands together then alternating.

4) Pull toner and stick apart then Rotate to right with elbows locked hold 20 seconds 5) Rotate to right holding 3-5 seconds and return to starting position 6) Repeat 5× and switch to opposite side Once individual is accomplished with use of one disc, perform "advanced" drills by KNEELING ON A SECOND balance disc to further enhance the neuromuscular concept.

As is apparent from the above examples, there are numerous exercises that can be performed using the method described herein in order to improve neuromuscular control and function across multiple joints and muscles. Depending on the ability of the individual, these exercises can be adapted and made more difficult as the user advances. For example, while the individual may start with one knee (in a kneeling position) or one foot (in a standing or seated position) on an unstable surface, the individual may progress to both knees (or both feet) on an unstable surface. In addition, the stance may also be altered to a staggered stance to make the exercises more difficult.

As can be seen from the examples, the stretching step can be accomplished using a stick coupled to an elastic band, a resistance harness, or a resilient or elastic band. Other means of providing tension could also be used in the present invention so long as they are capable of providing tension to the at least one muscle or joint as described herein.

As can also be seen from the examples, the series of sequential movements can be performed while standing, seated, kneeling, or lying down on an unstable surface. The series of exercise, either standing or sitting, can also be performed in a staggered stance in which one foot is positioned behind the other as illustrated in the figures.

As well, the unstable surface can be one or more of an unstable ball, a physioball, a balance ball, a wobble board, a leverage disc and other similar devices that are capable of providing the unstable surface. In a particularly preferred embodiment, the unstable surface is compressible.

In another embodiment, the present invention relates generally to a method of instructing an individual to perform a sequential series of movements in order to improve neuromuscular control and function across multiple joints and muscles, the method comprising the steps of:

a) positioning the individual on at least one unstable surface in a standing, sitting or kneeling position;

b) guiding the individual through a series of selective sequential movements capable of evoking specific motor responses in at least one muscle or joint for which it is desired to create functional resistance, said series of selective sequential movements comprising:

i) stretching the at least one muscle or joint by applying tension to the at least one muscle or joint, wherein the tension is applied by a stretching motion;

ii) keeping the tension applied to the at least one muscle or joint for a period of time;

iii) pivoting/twisting/engaging the torso or trunk and holding the pivoting/twisting/engaging position for a period of time;

iv) optionally, repeating steps i) through iii) multiple times to create a pattern of sequential movement;

wherein the pattern of sequential movement creates rotational multi-planar movements against resistance, and wherein the pattern of sequential movement allows selectively sequential stretching of the at least one muscle or joint.

Thus, an individual can perform the series of exercises in accordance with the present invention on their own or be guided by a trainer or physical therapist.

What is claimed is:

1. A method of performing a sequential series of movements in order to improve neuromuscular control and function across multiple joints and muscles of an individual, wherein the sequential series of movements are performed by the individual, the method comprising the steps of:

a) balancing a first portion of a body of the individual on a first unstable surface and a second portion of the body on a second unstable surface, independent of the first unstable surface, wherein each of the first unstable surface and the second unstable surface is compressible; and b) performing a series of selective sequential exercises capable of evoking specific motor responses in at least one muscle or joint of the individual for which it is desired to create functional resistance, said series of selective sequential exercises comprising:

i) stretching the at least one muscle or joint by applying tension to the at least one muscle or joint, wherein the tension is applied by a stretching motion, comprising:

generating vibrations throughout a muscular-skeletal structure of the individual by stretching a tension-creating apparatus;

ii) keeping the tension applied to the at least one muscle or joint;

iii) engaging a torso of the individual in an engaging position and holding the engaging position; and iv) repeating steps i) through iii) multiple times to create a pattern of sequential movements;

wherein the pattern of sequential movements creates rotational multi-planar movements against a resistance, and wherein the pattern of sequential movements allows selectively sequential stretching of the at least one muscle or joint.

2. The method according to claim 1, wherein the pattern of sequential movements is a diagonal pattern or an oscillating pattern that is created under elastic tension.

3. The method according to claim 1, wherein the tension-creating apparatus is a) a stick coupled to a resilient band, b) a resistance harness, or c) an elastic band.

4. The method according to claim 1, wherein the first unstable surface is an unstable ball, a balance ball, a wobble board, or a leverage disc.

5. The method according to claim 1, wherein the individual is seated on the first unstable surface and at least one foot of the individual is positioned on the second unstable surface.

6. The method according to claim 1, wherein a first foot of the individual is positioned on the first unstable surface and a second foot of the individual is positioned on the second unstable surface.

7. The method according to claim 1, wherein the individual is kneeling with a knee on at least one of the first unstable surface and the second unstable surface.

8. The method according to claim 6, wherein the individual is in a staggered stance.

9. A method of instructing an individual to perform a sequential series of movements in order to improve neuromuscular control and function across multiple joints and muscles of the individual, the method comprising the steps of:

a) positioning a first portion of a body of the individual on a first unstable surface and a second portion of the body on a second unstable surface, independent of the first unstable surface, in a standing, sitting, kneeling or lying down position, wherein each of the first unstable surface and the second unstable surface is compressible;

b) guiding the individual through said sequential series of movements capable of evoking specific motor responses in a least one muscle or joint of the individual for which it is desired to create functional resistance, said sequential series of movements comprising:

i) stretching the at least one muscle or joint by applying tension to the at least one muscle or joint, wherein the tension is applied by a stretching motion, comprising:

generating vibrations throughout a muscular-skeletal structure of the individual by stretching a resilient band coupled to a stick;

ii) keeping the tension applied to the at least one muscle or joint;

iii) engaging a torso or a trunk of the individual in an engaging position and holding the engaging position; and iv) repeating steps i) through iii) multiple times to create a pattern of sequential movements;

wherein the pattern of sequential movements creates rotational multi-planar movements against a resistance, and wherein the pattern of sequential movements allows selectively sequential stretching of the at least one muscle or joint.

10. The method according to claim 9, wherein the individual is guided through the pattern of sequential movements.

11. The method according to claim 10, wherein the pattern of sequential movements are sport specific.

* * * * *